US009052628B2

(12) United States Patent
Mukai et al.

(10) Patent No.: US 9,052,628 B2
(45) Date of Patent: Jun. 9, 2015

(54) IMAGE FORMING APPARATUS HAVING COLLECTING OPERATION FOR RESIDUAL TONER

(75) Inventors: Takashi Mukai, Kawasaki (JP); Masahiro Yoshida, Tokyo (JP); Koichiro Takashima, Fujisawa (JP); Nobuo Oshima, Kawasaki (JP); Kohei Matsuda, Fujisawa (JP); Kuniaki Tamagaki, Kawasaki (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 13/559,880

(22) Filed: Jul. 27, 2012

(65) Prior Publication Data

US 2013/0028641 A1 Jan. 31, 2013

(30) Foreign Application Priority Data

Jul. 29, 2011 (JP) ..... 2011-166700

(51) Int. Cl.
*G03G 15/14* (2006.01)
*G03G 15/01* (2006.01)
*G03G 21/00* (2006.01)

(52) U.S. Cl.
CPC ..... *G03G 15/0189* (2013.01); *G03G 21/0064* (2013.01); *G03G 2215/0132* (2013.01)

(58) Field of Classification Search
USPC ..... 399/26, 27, 98, 99, 127–129, 308, 315, 399/359
See application file for complete search history.

(56) References Cited

U.S. PATENT DOCUMENTS

| | | | | |
|---|---|---|---|---|
| 7,477,863 | B2 * | 1/2009 | Watanabe et al. | 399/101 |
| 7,650,086 | B2 * | 1/2010 | Takahashi et al. | 399/27 |
| 2012/0275804 | A1 * | 11/2012 | Watanabe | 399/39 |
| 2012/0321329 | A1 * | 12/2012 | Yoshida | 399/38 |

FOREIGN PATENT DOCUMENTS

| | | | | |
|---|---|---|---|---|
| JP | 11-84827 | A | | 3/1999 |
| JP | 11084827 | A | * | 3/1999 |
| JP | 2001-194871 | A | | 7/2001 |
| JP | 2001194871 | A | * | 7/2001 |
| JP | 2009-116130 | A | | 5/2009 |
| JP | 2009116130 | A | * | 5/2009 |

* cited by examiner

*Primary Examiner* — Francis Gray

(74) *Attorney, Agent, or Firm* — Fitzpatrick, Cella, Harper & Scinto

(57) ABSTRACT

An image forming apparatus includes multiple image forming stations, and a controller for executing selectively a multicolor image mode or a monochromatic image forming mode, wherein in the monochromatic image forming mode, a first one of image forming stations which forms the image, and a second one which is upstream of the first image forming station exposes the image bearing members to a first image pattern and a second image pattern, respectively, and the controller determines the second image pattern in accordance with the first image pattern, and effects the exposure to the second image pattern.

15 Claims, 6 Drawing Sheets

IMAGE FORMING APPARATUS HAVING COLLECTING OPERATION FOR RESIDUAL TONER

FIELD OF THE INVENTION AND RELATED ART

The present invention relates to an image forming apparatus of the inline (tandem) type.

A large number of conventional image forming apparatuses, such as copying machines, printers, etc., employ an electrophotographic recording method, an electrophotographic recording method, or the like. It has been known that these image forming apparatuses, in particular, color image forming apparatuses, employ an intermediary transferring means. That is, these apparatuses have multiple image forming stations (units) and an intermediary transferring member. The image forming stations are in alignment in the direction parallel to the moving direction of the image bearing surface of the intermediary member. Each image forming station has a photosensitive member (image bearing member). In operation, a toner image is formed on the photosensitive member of each image forming station. Then, the toner images on the multiple photosensitive members, one for one, are sequentially and temporarily transferred in layers (primary transfer) onto the intermediary transferring member, and then, are transferred together (secondary transfer) from the intermediary transferring member onto a sheet of recording medium.

An image forming method which employs an intermediary transferring means such as the above described one is advantageous over an image forming apparatus which does not employ an intermediary transferring means, that is, an image forming apparatus which transfers from its multiple photosensitive members, multiple toner images, different in color, directly onto a sheet of recording medium, in that the former can more reliably transfer multiple toner images onto various types of recording mediums than the latter. Further, there have been widely in use various color image forming apparatuses of the so-called inline type. A color image forming apparatus of the inline type has multiple photosensitive members, and an equal number of developing devices which are different in the color of the toner they use. The photosensitive members are aligned along the intermediary transferring member, in the direction parallel to the moving direction of the intermediary transferring member, in contact with the intermediary transferring member.

For example, an electrophotographic full-color image forming apparatus of the intermediary transfer type, which is based on four primary colors, forms yellow, magenta, cyan, and black toner images, on its four photosensitive members, one for one, and sequentially transfers in layers (primary transfer) the four toner images, different in color, onto its intermediary transferring member, which is in the form of an endless belt or a drum. Then, it transfers together (secondary transfer) the toner images, different in color, onto a sheet of recording medium.

However, it is impossible to make an electrophotographic full-color image forming apparatus of the intermediary transfer type 100% in the efficiency with which a toner image (images) is transferred from the intermediary transferring member onto a sheet of recording medium (secondary transfer). That is, a minuscule amount of toner remains on the intermediary transferring member after the secondary transfer. This toner remaining on the intermediary transferring member after the secondary transfer is scraped away by a cleaning blade, or is transferred back onto one or more of the photosensitive members during a subsequent toner image transfer from the photosensitive drums onto the intermediary transferring member, to be recovered by the cleaning blade of the photosensitive drum cleaning devices (Japanese Laid-open Patent Application 2009-116130).

A color image forming apparatus such as those described above can be operated in various image formation modes. Among these modes, there is an image formation mode, for example, a monochromatic mode, in which it is unnecessary to use all of its image formation stations to form an image. Thus, in order to prevent the problem that the photosensitive member in an image forming station which is not used for image formation is unnecessarily deteriorated by the contact between the photosensitive member and intermediary transferring member, some color image forming apparatuses are structured so that the photosensitive member and intermediary transferring member in the image forming station which is not going to be used for the following image forming operation are separated from each other before the following operation is started.

However, structuring a color image forming apparatus as described above requires a mechanism for separating a photosensitive member from an intermediary transferring member, resulting in an increase in the size and cost of a color image forming apparatus. Further, it causes the following problems. That is, when a color image forming apparatus is switched in operational mode from the monochromatic mode to the full-color mode, or vice versa, its image bearing members are placed in contact with, or separated from, its intermediary transferring member, which causes a substantial amount of impact. This impact causes the intermediary transferring member to ripple, or behave in the like manner, which in turn may delay the starting of the next image forming operation and/or may result in the formation of an unsatisfactory image. Therefore, structuring a color image forming apparatus so that when the apparatus is in the monochromatic mode, the photosensitive members which are not going to be used for image formation are not separated from the intermediary transferring member is advantageous from the standpoint of keeping a color image forming apparatus as small as possible in size and cost, and also from the standpoint of image quality, than structuring a color image forming apparatus as described above.

Structuring a color image forming apparatus so that a photosensitive member does not separate from an intermediary transferring member requires that even the photosensitive member in each of the image forming stations which are not going to be used for image formation is driven in synchronism with the driving of the intermediary transferring member, for the following reason. That is, if a photosensitive member is kept stationary while the intermediary transferring member is driven, the portion of the photosensitive member, which is in contact with the intermediary transferring member is frictionally worn, which results in the formation of an unsatisfactory image.

Further, even if a photosensitive member is not being used for image formation, it is shaved by the friction between itself and a cleaning blade or the like. Further, even the voltage to be applied to a photosensitive member which is not going to be used for the immediately following image forming operation has to be properly set for the following reason. That is, if a photosensitive member is in contact with a developing device, the relationship between the potential level of the photosensitive member and that of the developer bearing member of the developing device has to be set so that the potential of the developer bearing member of the developing device is the same as that of the portions of the peripheral surface of the photosensitive member, which correspond to the blank portions of the image to be formed, in order to prevent the formation of a foggy image.

The developer which failed to transfer from an intermediary transferring member onto a sheet of recording medium, that is, the developer which is remaining on the intermediary transferring member after the secondary transfer, is recovered by an upstream photosensitive member in terms of the moving direction of the intermediary transferring member. Therefore, it is possible that the waste toner container of the most upstream image forming station will be prematurely filled up and/or the waste toner will spill from the waste toner container of the most upstream image forming station. This phenomenon hereafter may be referred to as "brimming". If the waste toner container is brimmed, such a problem that an image forming apparatus is soiled, and/or toner scatters out of an image forming apparatus is likely to occur. Therefore, the relationship in potential between a transferring device and a photosensitive member has to be set so that the developer remaining on the intermediary transferring member is not recovered by the photosensitive member.

Thus, it has been proposed to design a color image forming apparatus so that when the apparatus is in a mode other than the full-color mode, even the photosensitive member which are not in use for an ongoing image forming operation are charged in the same manner as the photosensitive member which is in use for the ongoing image forming operation, in order to prevent the developer remaining on the intermediary transferring member from being recovered by the photosensitive members which are not in use for the ongoing image forming operation. This structural arrangement, however, suffers from the following problem. That is, the photosensitive drums which are not in use for the ongoing image forming operation are deteriorated by the electrical discharge which occurs when the photosensitive member is charged, even though they are not in use for the ongoing image forming operation. Therefore, it has been proposed to design a color image forming apparatus so that the voltage applied to the charge roller for charging a photosensitive member which is not in use for the ongoing image forming operation is reduced in absolute value to weaken the electrical discharge between the photosensitive member and charge roller (Japanese Laid-open Patent Application 2001-194871). It has been also proposed to design a color image forming apparatus so that in order to prevent a photosensitive member from being frictionally worn, the developer bearing member and transferring member are properly set in terms of potential level, without involving electrical discharge (Japanese Laid-open Patent Application H11-84827).

In recent years, for size reduction, some color image forming apparatuses are not provided with a mechanism for separating a photosensitive member from an intermediary transferring member in the primary transfer station. In the case of those color image forming apparatuses, a photosensitive member is rotated even when they are in the monochromatic mode. Therefore, if they are significantly more frequently used in the monochromatic mode than in the full-color mode, the photosensitive members in the image forming stations other than the image forming station used for the monochromatic mode are likely to be prematurely deteriorated.

For the same reason as the one given above, it is a common practice to structure a color image forming apparatus so that the electric power source for applying charge bias to a charge roller is shared by the multiple image forming stations of the apparatus. In the case of an electrophotographic full-color image forming apparatus which employs only one charge bias power source for the multiple image forming stations of the apparatus, if the apparatus is put in the monochromatic mode, charge bias is applied to even the charge roller in the image forming stations other than the one which is in use for the ongoing image forming operation. Therefore, unless the charge bias is properly set in potential, even the photosensitive members in the image forming stations other than the one which is in use for the ongoing image forming operation are deteriorated by the electric discharge which occurs when the image bearing members are charged.

It is assumed here that an electrophotographic full-color image forming apparatus employs four image forming stations, that is, first, second, third, and fourth stations, listing from the upstream side in terms of the direction in which the portion of the intermediary transferring member of the apparatus, which is in contact with the photosensitive members, moves, and also, that the first, second, third, and fourth image forming stations form yellow, magenta, cyan, and black monochromatic toner images, respectively. Such an electrophotographic full-color image forming apparatus is likely to be structured so that the image forming station for forming a black monochromatic toner image is the fourth station, for the following reason. That is, structuring an electrophotographic image forming apparatus so that the station for forming a black monochromatic toner image is the fourth station minimizes the distance by which a black monochromatic toner image is conveyed from where it is transferred onto the intermediary transferring member to where it is transferred onto recording medium. Therefore, the length of time it takes for the first print to be outputted in the black monochromatic mode is minimized.

Further, in the black monochromatic mode (black-and-white mode), images are formed only in the image forming station for forming a black toner image. Therefore, an electrophotographic full-color image forming apparatus of the tandem type, which employs an intermediary transferring member, is likely to be structured so that when the apparatus is in the black-and-white monochromatic mode, the secondary transfer residual toner, that is, the toner remaining on the intermediary transferring member after the secondary transfer, is recovered in only the image forming station for forming a black toner image, for the following reason. That is, if the apparatus is structured so that the secondary transfer residual toner can be recovered in the image forming stations other than the image forming station for forming a black toner image, as well as in the image forming station for forming a black toner image, the secondary transfer waste toner accumulates in the cleaning devices in the image forming stations other than the image forming station for forming a black toner image, as well as in the cleaning devices in the image forming stations other than the image forming station for forming a black toner image, even when only the fourth image forming station, that is, the image forming station for forming a black toner image, is in use.

In particular, in the case of an electrophotographic full-color image forming apparatus structured so that its image forming stations are made up of a process cartridge, it sometimes becomes necessary to replace the process cartridges (for example, process cartridge for forming yellow toner image) other than the one for forming a black toner image, even though the apparatus has been used mostly in the black monochromatic mode, or the like situation occurs.

In recent years, an electrophotographic full-color image forming apparatus has increased in the ratio among various image forming apparatuses. Therefore, there has increased the frequency with which an electrophotographic full-color image forming apparatus is used in the monochromatic mode (black monochromatic mode, in particular). If the frequency with which an electrophotographic full-color image forming apparatus is used in the black monochromatic mode is significantly higher than the frequency with which it is used in the other monochromatic mode other than the black monochromatic mode, it is likely for the waste toner container of the process cartridge in the image forming station which is not in use for the ongoing image forming operation to be prematurely filled up with the secondary transfer residual toner from the image forming station which is in use for the formation of a black toner image. Therefore, an electrophotographic full-color image forming apparatus is desired to be structured so that when the apparatus is in the black monochromatic mode, the secondary transfer residual toner is recovered by the cartridge for the formation of a black toner image.

Therefore, in order to prevent the problem that when an electrophotographic full-color image forming apparatus is in black monochromatic mode, the secondary transfer residual toner is recovered in the image forming stations other than the station which is in use for the formation of a black toner image, some electrophotographic full-color image forming apparatuses are structured so that when they are in the black monochromatic mode, such a bias that is opposite in polarity from the ordinary primary transfer bias is applied to the primary transferring members in the image forming stations other than the one which is in use for image formation. For example, when an electrophotographic full-color image forming apparatus which develops in reverse an electrostatic latent image with the use of negatively chargeable toner is in a normal image forming operation, positive bias is applied to the primary transferring members, whereas when it is in the monochromatic mode, negative bias is applied in order to prevent the secondary transfer residual toner from being recovered in the image formation stations other than the one which is being used for image formation, for the following reason. That is, with the application of the negative bias to the primary transferring member, the secondary transfer residual toner is positively charged in the cleaning device for cleaning the intermediary transferring member.

Further, some electrophotographic full-color image forming apparatuses are designed so that when they are in the black monochromatic mode, the entirety of the peripheral surface of the photosensitive member in each of the image forming stations other than the one which is in use for image formation is exposed with the use of the exposing device for image formation, to remove a certain amount of negative charge from the peripheral surface of the photosensitive member in order to reduce the peripheral surface of the photosensitive drum in the amount of charge (negative charge). Here, "charging the entirety of the peripheral surface of the photosensitive member" means exposing the peripheral surface of the photosensitive member as if forming a solid black image large enough to cover the entirety of the peripheral surface of the photosensitive member, for the following reason. That is, in the case of an electrophotographic full-color image forming apparatus having only one electric power source for charge bias, when it is in the monochromatic mode, even the peripheral surface of the photosensitive member in the image forming stations other than the one which is being used for the ongoing image forming operation is negatively charged. Thus, the peripheral surface of the photosensitive member in the image forming stations other than the one which is being used for the ongoing image forming operation is reduced in the amount of electric charge (negative charge) by exposing in entirety the peripheral surface of the photosensitive member, in order to reduce the peripheral surface of the photosensitive member in the amount of electrical charge (negative charge) to minimize the amount by which the secondary transfer residual toner, which is positively charged, is recovered by the photosensitive member in the image forming stations other than the one which is being used for image formation.

By applying the above described bias, which is opposite in polarity from the primary transfer bias to the primary transferring member in the image forming stations other than the one which is being used for image formation, as described above, and exposing the entirety of the peripheral surface of the photosensitive member in the image forming stations other than the one which is being used for image formation, as described, it is possible to recover the secondary transfer residual toner generated in the black toner image forming station, while allowing virtually no secondary transfer residual toner to be recovered in the image forming stations other than the black toner image forming station. Therefore, it is possible to prevent the waste toner container of the image forming station other than the one which is being used for image formation from being prematurely filled up with the waste toner (secondary transfer residual toner) from the image forming station being used for image formation, in the monochromatic mode.

In the image forming stations of an electrophotographic full-color image forming apparatuses structured as described above, other than the one which is being used for image formation, however, the application of charge bias is continued, and also, the photosensitive member is reduced in potential level by the exposure of the entirety of the peripheral surface of the photosensitive member, even when the apparatus is in the monochromatic mode. Therefore, the electrical discharge attributable to the charging device is repeated. It has been widely known that the photosensitive member is shaved by the electrical discharge attributable to the charging device. In the case of an electrophotographic full-color image forming apparatus in which a single electric power source is shared by multiple charging devices, the peripheral surface of the photosensitive member in the image forming stations other than the one which is being used for image formation is continuously shaved by the charging device even when the apparatus is in the monochromatic mode, and therefore, they are not being used for image formation. Moreover, as the photosensitive member in the image forming station other than the one which is being used for image formation is exposed across the entirety of its peripheral surface in order to prevent the aforementioned secondary transfer residual toner, which is positive in polarity, from being recovered by the image forming station other than the one being used for image formation, the electrical discharge attributable to the charging device is increased in the frequency of its occurrence, which in turn increases the amount by which the photosensitive members in the image forming stations other than the one being used for image formation are shaved by the electrical discharge.

That is, in the case of an electrophotographic full-color image forming apparatus structured so that when it is in the monochromatic mode, the photosensitive members in the image forming stations other than the one being used for image formation are exposed across the entirety of their peripheral surface in order to prevent the waste toner container in the image forming stations other than the one being used for image formation, from being prematurely filled up, the amount by which the photosensitive members are deteriorated is proportional to the frequency with which the apparatus is used in the monochromatic mode.

SUMMARY OF THE INVENTION

Thus, the primary object of the present invention is to provide an electrophotographic full-color image forming apparatus of the so-called inline type which does not suffer from the problem that when it is in the monochromatic mode, the image bearing members in the image forming stations other than the one being used for image formation are deteriorated, and also, the problem that when it is in the monochromatic mode, the waste toner container in the image forming stations other than the one being used for image formation is filled up with the secondary transfer residual toner from the image forming station being used for image formation.

According to an aspect of the present invention, there is provided an image forming apparatus a movable intermediary transfer member for receiving a developed image; a plurality of image forming stations arranged along a moving direction of said intermediary transfer member, said image forming stations each including a rotatable image bearing member, charging means for charging said image bearing member, exposure means for exposing said image bearing member charged by said charging means to light to form an electrostatic latent image on said image bearing member, developing means for developing the electrostatic latent image formed on said image bearing member into a developed image, primary transferring means for primary-transferring the developed image from said image bearing member onto said intermediary transfer member at a primary transfer position where image bearing member cleaning means for removing a developer remaining on said image bearing member after transfer of the developed image from said image bearing member onto said intermediary transfer member, wherein different color developed images are formed on different image bearing members; secondary transferring means for secondary-transferring the developed image from said intermediary transfer member onto a recording material at a secondary transfer position; developer charging means charging the developer remaining to said intermediary transfer member at a position downstream of the secondary transfer position and upstream of a primary transfer position of said image forming station which is at an upstreammost position with respect to a moving direction of said intermediary transfer member, after the secondary transfer of the developed image from said intermediary transfer member onto the recording material; and control means for executing selectively a multi-color image forming mode operation in which said plurality of image forming stations are operated to form a multi-color image in which multi-color developed images are overlaid on said intermediary transfer member, or a monochromatic image forming mode in which one of said image forming stations is operated to form a monochromatic developed image on said intermediary transfer member, wherein said control means rotates said image bearing member in said plurality of image forming stations and applies a charging bias voltage to charging means of said plurality of image forming stations, in the monochromatic image forming mode, and wherein in the monochromatic image forming mode, a first image forming station of said image forming stations which forms the image, and a second image forming station of said image forming stations which is upstream of said first image forming station with respect to the moving direction of said intermediary transfer member exposes said image bearing members to a first image pattern and a second image pattern, respectively, and said control means determines the second image pattern in accordance with the first image pattern, and effects the exposure to the second image pattern.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described with reference to the appended drawings. However, the measurement, material, and shape of the structural components of the image forming apparatus in the following embodiments of the present invention, and the positional relationship among the structural components, are not intended to limit the present invention in scope. That is, the present invention is to be modified according to the structure of the image forming apparatus to which the invention is applied, and various conditions under which the image forming apparatus to which the present invention is applied are used.

Embodiment 1

(1) General Structure of Image Forming Apparatus)

Figure 1:
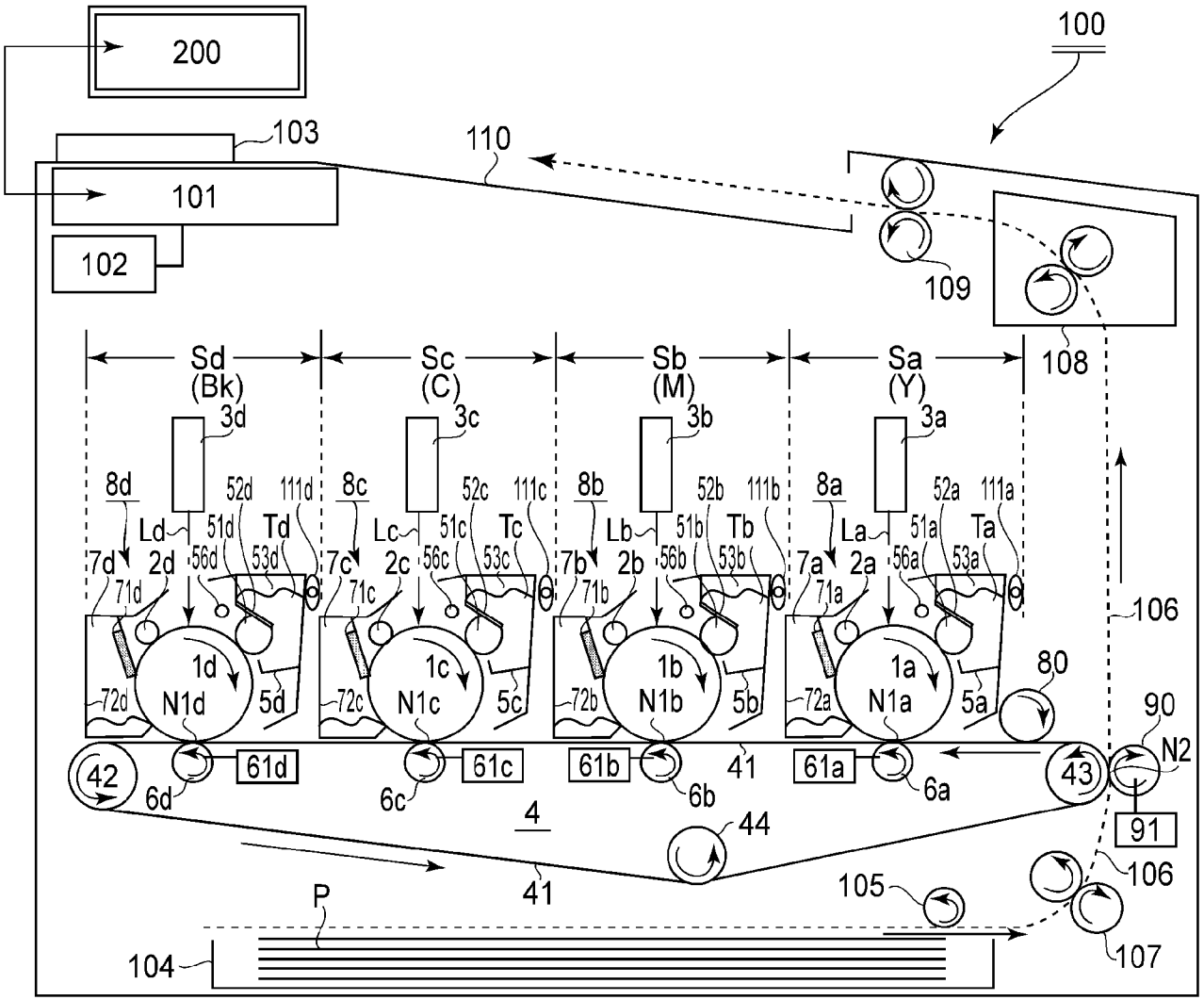
FIG. 1 is a schematic sectional view of the image forming apparatus in the first embodiment of the present invention, and shows the general structure of the apparatus.
Figure 2:
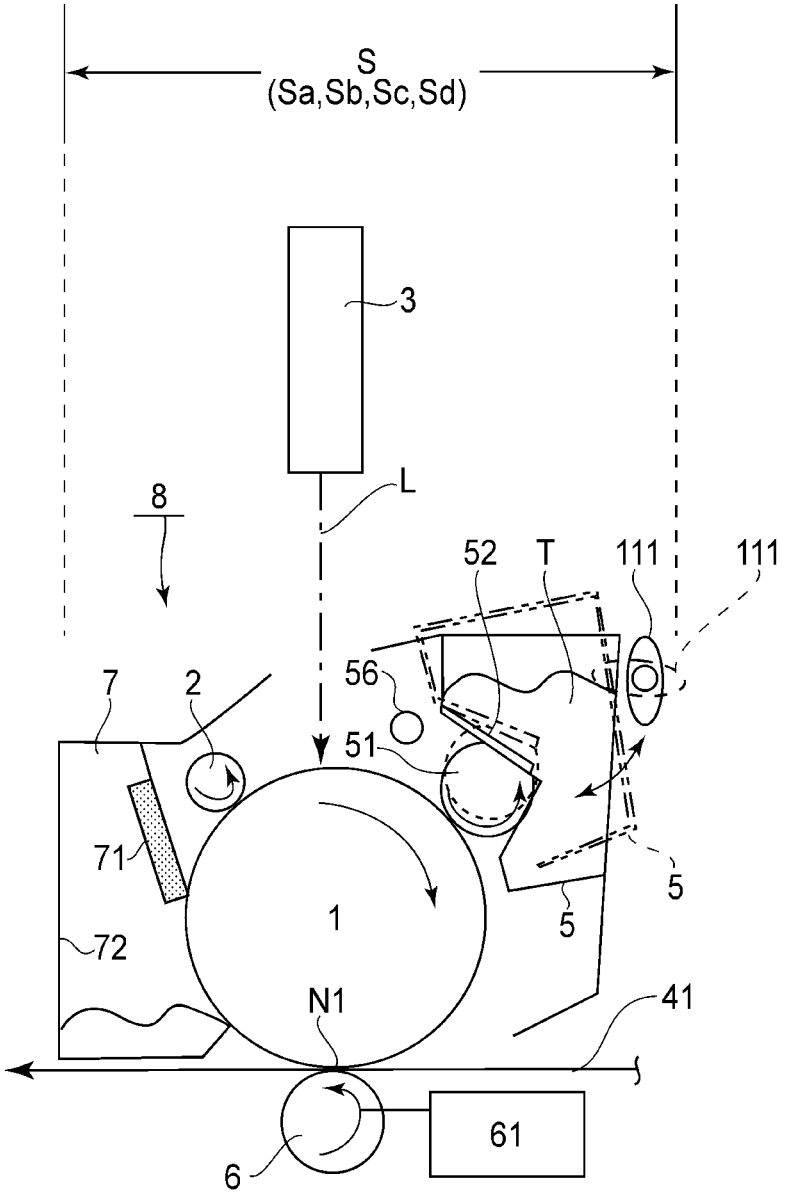
FIG. 2 is an enlarged schematic sectional view of one of the image forming stations in FIG. 1.
Figure 3:
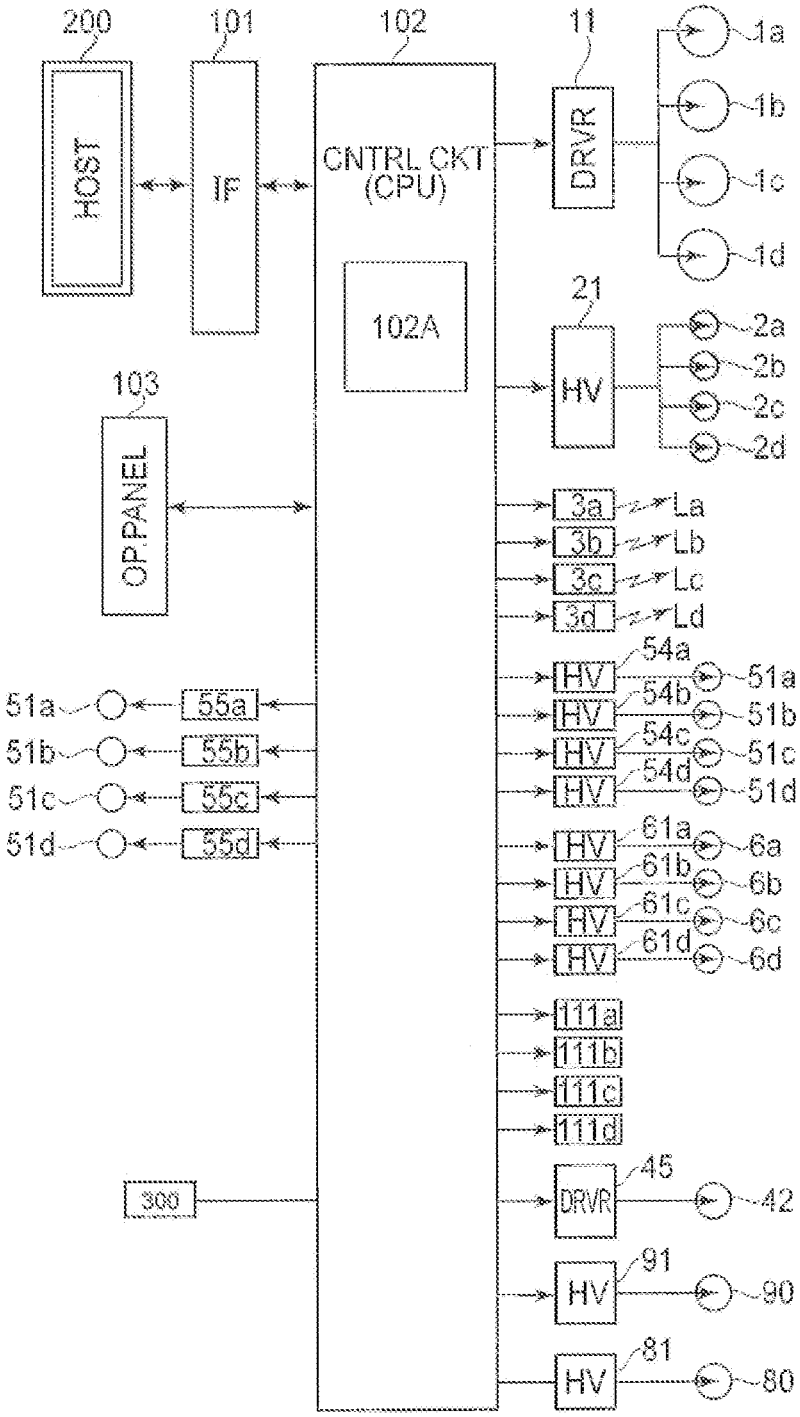
FIG. 3 is a block diagram of the control system of the image forming apparatus in the first embodiment.

FIG. 1 is a schematic sectional view of the essential portions of the image forming apparatus 100 in this embodiment, and shows the general structure of the apparatus. FIG. 2 is an enlarged schematic sectional view of one of the image forming stations in FIG. 1. FIG. 3 is a block diagram of the control system of the image forming apparatus in the first embodiment. The apparatus 100 is an electrophotographic full-color image forming apparatus (color laser printer) of the intermediary transfer type, and also, of the inline type. The image formation signals (electrical information of image to be formed) from a host apparatus 200 are inputted into the control circuit 102 (CPU: controlling means) of the apparatus 100 through the image formation signal receiving means 101 (IF). The control circuit 102 operates the apparatus 100 in the multicolor image formation mode or monochromatic image formation mode, based on the inputted image formation signals. The multicolor image formation mode is for forming a multicolor image on a sheet P of recording medium 1, and the monochromatic image formation mode is for forming a monochromatic image on a sheet P of recording medium.

The host apparatus 200 is an image reading apparatus (image reader), a personal computer (PC), a network terminal, a facsimile machine (from which image formation signals are sent), a word processor, or the like. The control circuit 102 exchanges various information in the form of a sequence of electrical signals, with the control panel 103 (which comprises display or the like) and/or the host apparatus 100. Further, it monitors and controls the operations of the various devices in the apparatus 100, and also, integrally controls the printing operation (image forming operation) of the image forming apparatus 100, based on preset control programs and referential tables. A sheet P of recording medium is a sheet of medium on which a toner image can be formed. It is a sheet of ordinary paper, an OHT sheet, a sheet of labels, or the like.

In this embodiment, the apparatus 100 has multiple (four) image forming stations, more specifically, the first to fourth image forming stations Sa, Sb, Sc and Sd (which hereafter will be referred to simply as "stations Sa, Sb, Sc and Sd"), listing from the right side of FIG. 1. The four stations S are horizontally aligned in tandem, and form images of developers, different in color, in synchronism. Each of the four stations S is an electrophotographic image formation system on its own. They are the same in structure although they are different in the color (yellow, magenta, cyan, and black, respectively) of the developer (which hereafter may be referred to simply as "toner") stored in their developing device.

The four stations Sa, Sb, Sc and Sd are mostly the same in structure (structural components) and operation. Thus, they are described together by eliminating from the referential codes, the suffixes a, b, c, and d which indicate yellow, magenta, cyan and black colors, respectively, added to show the color of the monochromatic toner image they form.

Each station S has a rotatable electrophotographic photosensitive member (which hereafter may be referred to simply as "drum"), which is an image bearing member and is in the form of a drum. The drum 1 is negatively chargeable. It is a member on which a toner image is formed. The drum 1 has a photosensitive layer made up of a charge generation layer and a charge transfer layer. The charge generation layer covers the peripheral surface of the substrate of the drum 1, and contains a charge generating substance. The charge transfer layer (surface layer: CT layer) covers the outward surface of the charge generation layer, and contains a substance capable of transferring electrical charge.

The drum 1 in each station S is rotated in the clockwise direction, indicated by an arrow mark, at a preset speed (100 mm/s in this embodiment), by a driving device 11 (FIG. 3) which is under the control of the control circuit 102. Each station S is provided with means for processing the drum 1, more specifically, a charging means 2, an exposing means 3, a developing means 5, a primary transferring means 6, and an image bearing means cleaning means 7, which are in the adjacencies of the peripheral surface of the drum 1.

The charging means 2 is a means for uniformly charging the peripheral surface of the drum 1 to preset polarity and potential level. The charging means 2 in this embodiment is in the form of a roller (charge roller). The charge roller 2 is made up of a metallic core, and an electrically conductive rubber layer which covers the peripheral surface of the metallic core. It is positioned in parallel to the drum 1, and is kept in contact with the peripheral surface of the drum 1 by the application of a preset amount of pressure. It is rotated by the rotation of the drum 1.

To the metallic core of the charge roller 2 of each station S, a preset charge bias is applied from a charge bias power source 21 as a charge bias applying means. The charge bias power source 21 is under the control of the control circuit 102, and is shared by the four stations S. Thus, when the power source 21 is ON, the charge bias, which is negative in polarity and preset in potential level, is applied to the charge roller 2 of each of all the stations S. With the application of the charge bias, electrical discharge occurs between the charge roller 2 and drum 1. Thus, the peripheral surface of the drum 1 in each of all the stations S is uniformly and negatively charged to a preset potential level VD (dark potential level) while the charge roller 2 is rotated.

The exposing means 3 is a means for exposing the uniformly charged area of the peripheral surface of the drum 1 with a beam of light modulated with electrical signals which reflect the information of the image to be formed. The exposing means 3 in this embodiment is a laser scanner which is under the control of the control circuit 102. The scanner 3 scans (exposes) the uniformly charged area of the peripheral surface of the drum 1 with a beam L of laser light, which it emits while modulating the beam with the information (digital image formation signals) of the image to be formed, inputted into the control circuit 102 from the host apparatus 200 through an image formation signal receiving means 101. As the uniformly charged area of the peripheral surface of the drum 1 is exposed to the beam L of laser light, exposed points of the uniformly charged area of the peripheral surface of the drum 1 attenuate in potential level: they reduce in potential to a level DL (light potential level). As a result, an electrostatic latent image, which reflects the exposure, is effected on the peripheral surface of the drum 1 by the electrostatic contrast between the points with the potential level VD and those with the potential level DL.

The developing means 5 is a means that develops an electrostatic latent image formed on the peripheral surface of the drum 1, into a visible image, that is, an image formed of developer (toner) with the use of the developer (toner) charged to its normal polarity. In this embodiment, it is of the so-called contact type. It develops an electrostatic latent image in reverse. It uses nonmagnetic single-component negative toner as developer T. It reversely develops a negative electrostatic latent image. Thus, the normal polarity, or the intrinsic polarity of the toner used by the developing device 5, is negative.

This developing device 5 has a development roller 51 as a developer bearing member which is rotated in contact with the drum 1 while bearing toner. It has also a developer regulating member 52, a developer storage chamber (hopper), etc. The developer regulating member 52 is for coating the peripheral surface of the development roller 51 with a thin layer of toner while charging the toner. The developer storage chamber 53 stores toner.

The development roller 51 comprises an elastic layer made of elastic rubber, or the like. It is rotated by a driving device 55 which is under the control of the control circuit 102. As it is rotated, its peripheral surface is coated with a thin layer of toner. While the development roller 51 is rotated in contact with the drum 1, development bias is applied to the development roller 51, with a preset timing, from a developer bias power source 54, which is under the control of the control circuit 102. Thus, toner adheres to the points of the peripheral surface of the drum 1, which are DL (light potential level) in potential level: the electrostatic latent image is developed in reverse into a visible image, that is, an image formed of the toner.

In the drum 1*a* of the first station Sa, yellow toner Ta is stored to form a yellow toner image on the drum la. In the drum 1*b* of the second station Sb, magenta toner Tb is stored to form a magenta toner image on the drum 1*b*. In the developing device 5*c* of the third station Sc, cyan toner Tc is stored to form a cyan toner image on the drum 1*c*. In the developing device 5*d* of the fourth station Sd, black toner Td is stored to form a black toner image on the drum 1*d*.

That is, the multiple stations S, more specifically, the first to fourth stations Sa-Sd, are different in the color of the toner image formed on their drum 1.

The primary transferring means 6 in this embodiment is in the form of an electrically conductive roller (primary transfer roller). The four primary transfer rollers 6 are within the loop which an intermediary transfer belt 41 (as intermediary transferring member) of an intermediary transfer unit (which will be described later) forms. Each of the primary transfer rollers is kept pressed against the downwardly facing portion of the peripheral surface of the corresponding drum 1, with the presence of the intermediary transfer belt 41 between itself and the drum 1, forming thereby a primary transfer station N1 (primary transfer nip).

To each primary transfer roller 6, primary transfer bias is applied with a preset timing, from the corresponding one among multiple (four) primary transfer bias power sources 61 as transfer bias applying means which are under the control of the control circuit 102. With the application of the primary transfer bias to the primary transfer roller 6, such an electric field that works in the direction to make the normally charged (negatively charged toner, in this embodiment) transfer from the drum 1 onto the intermediary transfer belt 41. Thus, the toner image on the drum 1 transfers onto the surface of the belt 41 (primary transfer).

The primary transfer bias power source 61 is such a power source that can be switched in bias polarity. That is, it can be switched in the polarity of the bias to be applied to the primary transfer roller so that when the image forming apparatus 100 is in the monochromatic mode, the secondary transfer residual toner remaining on the belt 41 is not recovered by the drum 1.

The image bearing member cleaning device 7 in this embodiment is a cleaning device which employs a cleaning blade 71 as a cleaning member. It is such a means that removes and recovers the toner (residual toner) which failed to transfer from the drum 1 onto the belt 41, and therefore, remaining on the peripheral surface of the drum 1 after the primary transfer, with the use of the cleaning blade 71. The blade 71 is kept in contact with the peripheral surface of the drum 1 with the application of a preset amount of pressure, in such an attitude that its cleaning edge is on the upstream side of its base portion, in terms of the moving direction of the peripheral surface of the drum 1. Thus, the primary transfer residual toner and the like contaminants on the peripheral surface of the drum 1 are scraped away by the cleaning edge of the blade 71, and are recovered into a waste toner container 72.

The apparatus 100 in this embodiment employs process cartridges 8 which integrally hold the charge roller 2, developing device 5 and cleaning device 7, and are removably installable in the stations S. That is, the process cartridge 8 is removably installable in the main assembly of the image forming apparatus 100. Therefore, the waste toner container 72 which is holding the residual toner and the like contaminants can be replaced by replacing the process cartridge 8 to which it belongs.

Incidentally, a term "process cartridge" means a cartridge in which an electrophotographic photosensitive member, and at least one among a charging means, a developing means, and a cleaning means which are for processing the electrophotographic photosensitive member, are integrally placed so that they can be removably installed in the main assembly of an electrophotographic image forming apparatus.

In this embodiment, process cartridges 8*a*-8*d* which contain yellow toner Ta, magenta toner Tb, cyan toner Tc, and black toner Td, respectively, are removably installed in the first to fourth stations Sa-Sd, respectively, listing from the upstream side in terms of the moving direction of the belt 41.

The cartridge 8 in this embodiment is made up of a drum unit and a development unit. The drum unit is made up of the drum 1, charge roller 2, and cleaning device 7, which are attached to the frame of the drum unit, whereas the development unit is made up of a developing device 5. The two units are connected to each other by a shaft 56, about which the development unit is rotationally movable. As the cartridge 8 is installed into a cartridge chamber in the main assembly of the apparatus 100 (which hereafter may be referred to simply as apparatus main assembly), its drum unit is precisely positioned and remains precisely positioned relative to the apparatus main assembly by a drum unit pressing mechanism (unshown) of the apparatus main assembly. As the drum unit is precisely positioned relative to the apparatus main assembly, the developing device 5 is placed in contact with the cam 111 of a developing device shifting mechanism of the apparatus main assembly. The cam 111 is under the control of the control circuit 102, and is rotatable to place the developing device 5 in a state in which the device 5 remains inactive, or a state in which the device 5 is active.

As the cam 111 is rotated into an attitude in which it keeps the developing device 5 in the state in which the developing device 5 is inactive, the developing device 5 is rotationally moved about the shaft 56 by compression springs (unshown) toward the drum unit, being thereby moved into its development position (contoured by solid line in FIG. 2), in which the development roller 51 is kept pressed upon the peripheral surface of the drum 1 by a preset amount of pressure. As the developing device 5 is moved into the development position, the development roller 51 is rotated, and development bias is applied to the development roller 51.

On the other hand, as the cam 111 is rotated into an attitude in which it keeps the developing device 5 in the state in which the device 5 is active, the developing device 5 is rotated against the aforementioned compression springs about the shaft 56 in the direction to move away from the drum unit, being thereby moved back into a position in which the development roller 51 is kept separated from the drum 1. Then, the developing device 5 is kept in this position (contoured by double-dot chain line in FIG. 2). When the developing device 5 is in this position, the development roller 51 is not rotated, and the development bias is not applied to the development roller 51.

There is an intermediary transfer unit 4 under the combination of the first to fourth stations Sa, Sb, Sc and Sd. The unit 4 has an intermediary transfer belt 41, as an intermediary transfer member, which is an endless and flexible belt formed of film. The transfer belt 41 is circularly movable. As the belt 41 is circularly moved, a toner image is transferred onto the belt 41 from each of the four stations S.

The belt 41 is suspended and kept stretched by multiple (three in this embodiment) belt supporting rollers (belt supporting-tensioning members), more specifically, a belt driving roller 42, a belt backing roller 43 (which opposes secondary transfer roller with presence of belt 41 between itself and secondary transfer roller), and a tension roller 44. In terms of the moving direction of the belt 41, the belt driving roller 42 is on the downstream side of the fourth station Sd, and the belt backing roller 43 is on the upstream side of the first station Sa. The tension roller 44 is between the rollers 42 and 43, and is positioned lower than the rollers 42 and 43.

As the belt driving roller 42 is driven by a driving device 45 which is under the control of the control circuit 102, the belt 41 circularly moves in the counterclockwise direction indicated by an arrow mark, at roughly the same speed as the peripheral velocity of the drum 1, which is 100 mm/sec. Thus, the direction in which the belt 41 moves in the area of contact between itself and drum 1 is the same as the direction in which the peripheral surface of the drum 1 moves in the area of contact between the belt 41 and drum 1.

The belt backing roller 43 and tension roller 44 are rotated by the circular movement of the belt 41. The primary transfer roller 6 of each station S is on the inward side of the loop which the belt 41 forms. It is kept pressed against the downwardly facing portion of the peripheral surface of the drum 1 with the presence of the belt 41 between itself and drum 1. The area of contact between the belt 41 and drum 1 is the primary transfer position N1 (primary transfer nip). The primary transfer roller 6 is rotated by the circular movement of the belt 41. In this embodiment, in terms of the moving direction of the top portion of the belt 41 with respect to the belt loop, the first station Sa is the most upstream station, and the fourth station Sd is the most downstream station.

A secondary transfer roller 90 as the secondary transferring means is positioned so that it opposes the portion of the belt backing roller 43, around which the belt 41 wraps. The secondary transfer roller 90 is an electrically conductive roller, the surface layer of which is formed of an elastic substance. It is kept pressed against the roller 43 with the presence of the belt 41 between the two rollers 90 and 43. The area of contact between the secondary transfer roller 90 and belt 41 is the secondary transfer position N2 (secondary transfer nip). The secondary transfer roller 90 is rotated by the circular movement of the belt 41. To the secondary transfer roller 90, a preset secondary transfer bias is applied with a preset timing from a secondary transfer bias power source 91 which is under the control of the control circuit 102.

In terms of the moving direction of the belt 41, there is a developer charging means 80 (intermediary transferring member cleaning device) on the downstream side of the secondary transfer roller 90 and on the upstream side of the primary transfer nip N1*a* of the first station Sa, or the most upstream station among the multiple stations S. The developer charging means 80 in this embodiment is in the form of an electrically conductive roller (belt cleaning roller), which is in contact with the belt 41.

The belt cleaning roller 80 is a means for preparing the secondary transfer residual toner, etc., on the belt 41 so that they can be recovered by the drum 1 of the station S. More concretely, it is a developer charging means which charges the toner on the belt 41 to the opposite polarity (positive polarity) from the normal toner polarity (negative in this embodiment). The belt cleaning roller 80 is rotated by the circular movement of the belt 41. Further, to the belt cleaning roller 80, a preset cleaning bias is applied with a preset control timing from a cleaning bias power source 81 which is under the control of the control circuit 102.

Below the unit 4 is a recording medium cassette 104, in which multiple sheets P of recording medium are stored in layers, and which is removably mountable in the apparatus main assembly. The sheets P of recording medium in the cassette 104 are moved out of the cassette 104 one by one while being separated from the rest by the rotation of a feed roller 105 which is under the control of the control circuit 102, and then, is introduced into a vertical sheet passage 106. Then, each sheet P of recording medium is conveyed to a pair of registration rollers 107.

The control circuit 102 controls the pair of registration rollers 107 so that each sheet P of recording medium is delivered to the secondary transfer position N2 (second transfer nip) with such a timing that the sheet P arrives at the position N2 at the same time as the toner image on the belt 41. At the same time, it applies the secondary transfer bias to the secondary transfer roller 90 from an electric power source 91. As the secondary transfer bias is applied to the secondary transfer roller 90, such an electric field that makes the toner, which has just been charged to the normal polarity (negative in this embodiment) by the secondary transfer bias, transfer from the belt 41 onto the sheet P, is generated. Thus, the toner images on the belt 41 are transferred (secondary transfer) onto the sheet P of recording medium, as if being peeled away from the belt 41, while the sheet P is conveyed, remaining pinched by the belt 41 and secondary transfer roller 90, through the secondary transfer nip N2.

After the transfer of the toner images onto the sheet P of recording medium in the secondary transfer nip N2, the sheet P is separated from the surface of the belt 41, and is introduced into a fixing device 108, which is above the secondary transfer roller 90. The fixing device 108 comprises a fixation roller and a pressure roller. The fixation roller is rotational, and is heated by its internal halogen heater. The pressure roller also is rotatable. It is kept pressed upon the fixation roller, forming thereby a fixation nip, through which the sheet P is conveyed. While the sheet P is conveyed, remaining pinched by the fixation roller and pressure roller, through the fixation nip of the fixing device 108, it is subjected to heat and pressure. Thus, the unfixed toner images on the sheet P are fixed to the sheet P; the unfixed toner images become solidly fixed to the sheet P. After being conveyed out of the fixing device 108, the sheet P is discharged as a finished print into a delivery tray 110 by a pair of discharge rollers 109.

During the secondary transfer, a minute amount of toner fails to be transferred from the belt 41 onto a sheet P of recording medium, remaining therefore on the belt 41 (Hereafter, this minute amount of toner may be referred to simply as "secondary transfer residual toner"). The secondary transfer residual toner is transferred back onto the drum 1 of station S, and is removed and recovered by the cleaning device 7 of the station S. Typically, the secondary transfer residual toner on the belt 41 is charged by the cleaning roller 80 (as means for cleaning intermediary transferring member: toner charging means). Then, it is transferred back onto the drum 1 during the immediately following primary transfer. After being transferred (adhered) back onto the drum 1, the secondary transfer residual toner is removed and recovered by the cleaning device 7 as a means for cleaning an image bearing member.

(2) Multicolor Image Formation Mode (Full-Color Mode)

Next, the full-color mode, that is, an image formation mode for outputting a full-color print based on the four primary colors, with the use of all of the first to fourth stations Sa, Sb, Sc and Sd (with use of all of primary colors), is described.

1) As the control circuit 102 receives a request for outputting a full-color print, from the host apparatus 100 or control panel 103, it activates the driving device 11 to rotate the drums 1 in all image forming stations S. Further, it activates a driving device 45 to circularly move the belt 41.

2) Further, the control circuit 102 applies a preset charge bias to the charge rollers 2 in all the stations S by turning on the electrical power source 21. Further, the control circuit 102 switches the cam 111 in attitude from the active attitude to the inactive attitude to move the developing device 5 in all stations 2 into the development position so that the development roller 51 is placed in contact with the drum 1. As soon as the developing device 5 is moved into the development position, the development roller 51 begins to be rotated, and a preset development bias begins to be applied to the development roller 51 from the electrical power source 54.

3) When the image forming apparatus 100 is in the above described state, the control circuit 102 begins to sequentially expose the peripheral surface of the drum 1 in the first to fourth stations Sa, Sb, Sc and Sd by sequentially turning on the scanner 3*a*, 3*b*, 3*c* and 3*d* in the first to fourth stations Sa, Sb, Sc and Sd, respectively, with preset control timings.

4) As a result, an electrostatic latent image, which corresponds to the yellow color component of the full-color image to be formed, is effected on the peripheral surface of the drum 1*a* in the first station Sa. This electrostatic latent image is developed by a developing device 5*a* into a visible image, that is, an image formed of yellow toner. Then, the toner image is transferred (primary transfer) onto the portion of the belt 41, which is being moved through the primary transfer nip N1*a*. This transfer of the toner image is done by the primary transfer roller 6*a* to which a preset transfer bias is being applied from an electric power source 61*a*. The toner which failed to be transferred onto the belt 41 at the primary transfer nip N1*a*, being therefore remaining on the peripheral surface of the drum 1*a*, is removed from the peripheral surface of the drum 1 by the cleaning device 7*a*.

In the second station Sb, an electrostatic latent image which corresponds to the magenta color component of the full-color image to be formed, is formed. Then, the latent image is developed by the developing device 5*b*, into a visible image formed of magenta toner. Then, the toner image is transferred onto the portion of the belt 41, which is being moved through the primary transfer nip N1*b*, in such a manner that it is layered onto the yellow toner image which has just been transferred onto the belt 41. This transfer of the magenta toner image is accomplished by the primary transfer roller 6*b*, to which a preset transfer bias is being applied from an electric power source 61*b*. The toner which failed to be transferred onto the belt 41 in the primary transfer nip N1*b*, being therefore remaining on the peripheral surface of the drum 1*b*, is removed from the peripheral surface of the drum 1*b* by a cleaning device 7*b*.

In the third station Sc, an electrostatic latent image which corresponds to the cyan color component of the full-color image to be formed, is formed. Then, the latent image is developed by the developing device 5*c*, into a visible image formed of cyan toner. Then, the toner image is transferred onto the portion of the belt 41, which is being moved through the primary transfer nip N1*c*, in such a manner that it is layered onto the yellow and magenta toner images which have just been transferred onto the belt 41. This transfer of the cyan toner image is accomplished by the primary transfer roller 6*c*, to which a preset transfer bias is being applied from an electric power source 61*c*. The toner which failed to be transferred onto the belt 41 in the primary transfer nip N1*c*, being therefore remaining on the peripheral surface of the drum 1*c*, is removed from the peripheral surface of the drum 1*c* by a cleaning device 7*c*.

In the fourth station Sd, an electrostatic latent image which corresponds to the black color component of the full-color image to be formed, is formed. Then, the latent image is developed by the developing device 5*d*, into a visible image formed of black toner. Then, the toner image is transferred onto the portion of the belt 41, which is being moved through the primary transfer nip N1*d*, in such a manner that it is layered onto the yellow, magenta, and cyan toner images which have just been transferred onto the belt 41. This transfer of the black toner image is accomplished by the primary transfer roller 6*d*, to which a preset transfer bias is being applied from an electric power source 61*d*. The toner which failed to be transferred onto the belt 41 in the primary transfer nip N1*d*, being therefore remaining on the peripheral surface of the drum 1*d*, is removed from the peripheral surface of the drum 1*d* by a cleaning device 7*d*.

Thus, as the portion of the belt 41, which is bearing the yellow toner image transferred onto the belt 41 in the primary transfer nip N1*a*, is sequentially moved through the primary transfer nips N1*b*, N1*c* and N1*d*, an unfixed full-color toner image is synthetically effected by the layered four monochromatic images, that is, yellow, magenta, cyan and black toner images, on the portion of the belt 41.

5) The unfixed full-color toner image synthetically formed on the belt 41 is conveyed to the secondary transfer nip N2 by the subsequent movement of the belt 41. Then, it is transferred (secondary transfer) onto a sheet P of recording medium which was fed into the apparatus main assembly from the cassette 104 and introduced into the secondary transfer nip N2 with a preset control timing by the pair of registration rollers 107 as described. Then, it is conveyed through the fixing device 108, and discharged as a full-color print into the tray 110.

6) The secondary transfer residual toner, that is, the toner which failed to be transferred onto a sheet P of recording medium during the secondary transfer process, and therefore, remained on the belt 41, is given electric charge by the belt cleaning roller 80 as the means (toner charging means) for cleaning the intermediary transferring member. Then, it is transferred back onto the drum 1 in the station S, and is removed and recovered by the cleaning device 7 in the station S.

In this embodiment, a combination of an AC voltage which is 1,000 Hz in frequency, 2,000 V in peak-to-peak voltage, and rectangular in waveform, and 1.3 kV of DC voltage, is applied to the belt cleaning roller 80 from the electric power source 81, not only when the image forming apparatus 100 is in the full-color mode, but also, in the monochromatic mode. With the application of this combination of voltages, the toner which failed to be transferred during the secondary transfer process, and therefore, remaining on the belt 41, is given positive electric charge.

When the image forming apparatus 100 is in the normal image formation mode, positive bias is applied to the primary transfer roller 6 in each station S. Therefore, in the full-color mode, the residual toner on the belt 41, which was positively charged by the belt cleaning roller 80, is transferred back onto the drum 1*a* in the first station Sa during the primary transfer, and is recovered by the cleaning device 7*a*.

7) The requested printing job is ended after an image forming operation such as the one described above is carried out to output prints by the number preset in the requested printing job.

As soon as the control circuit 102 ends the printing job, it puts all the cams 111, which are in the inactive state, into the active state, moving thereby the developing devices 5 in all the stations S into the inactive position, in order to separate the development roller 51 from the drum 1. Further, the control circuit 102 turns off all the electric power sources for bias application. Further, it turns off the driving mechanisms 11, 55 and 45, stopping the driving of the development rollers 51 and belt 41. Then, the control circuit 102 keeps the apparatus 100 on standby until it receives the next print request.

(3) Monochromatic Image Formation Mode (Monochromatic Mode)

The monochromatic mode is an image formation mode in which only one of the first to fourth image forming stations Sa, Sb, Sc and Sd is used for image formation. Here, the monochromatic mode is described with reference to the case in which only the fourth station Sd is used, that is the case in which only a black monochromatic image is formed. When the image forming apparatus 100 is in the black monochromatic mode, for example, the image forming station Sd, that is, the fourth station, is referred to as the first image forming station, and the first to third stations Sa, Sb, and Sc, that is, the stations which are on the upstream side of the fourth stations Sd (first station in black monochromatic mode) in terms of the moving direction of the belt 41 (intermediary transferring member) are referred to as the second image forming station.

The station for forming a black monochromatic toner image is the most downstream station in terms of the moving direction of the belt 41. Therefore, when the image forming apparatus 100 is in the monochromatic mode in which a black monochromatic toner image is formed, the distance by which a toner image is conveyed from where it is transferred (primary transfer) onto the belt 41 to the secondary transfer nip N2 where it is transferred onto a sheet P of recording medium is shorter than when the image forming apparatus 100 is in the monochromatic mode in which one of the stations other than the fourth station Sd is used. Therefore, positioning most upstream the station for forming a black monochromatic image reduces the length of time it takes for the first print to be outputted by the image forming apparatus 100 after the starting of the apparatus 100 in the black monochromatic mode.

1) As the control circuit 102 receives from the host apparatus 200 or control panel 103, a print request which requires the image forming apparatus 100 to be operated in the black monochromatic mode, it starts rotating the drum 1 in all stations S by activating the driving device 11. Further, it begins to circularly move the belt 41 by activating the driving device 45.

2) Further, the control circuit 102 begins to apply a preset charge bias to the charge roller 2 in all the stations S by turning on the electric power source 21. Further, it places the development roller 51*d* of the developing device 5*d* in the station Sd by moving the developing device 5*d* in the station Sd into the development position by switching the cam 111*d* in the station Sd in attitude (angle) (by rotating cam 111 from its active position to inactive position). Further, as soon as the developing device 5*d* moves into the development position, the control circuit 102 begins to rotate the development roller 51*d*, and begins to apply a preset development bias to the development roller 51*d* from the electric power source 54*d*.

However, the control circuit 102 keeps the cams 111*a*, 111*b*, and 111*c* in the first, second, and third stations Sa, Sb and Sc, respectively, in their active position. That is, the developing devices 5*a*, 5*b* and 5*c* in the first, second, and third stations Sa, Sb and Sc, respectively, are kept in their inactive position. Therefore, the development rollers 5*a*, 5*b* and 5*c* are kept separated from the drums 1*a*, 1*b*, and 1*c*, respectively, and are not rotated. Further, development bias is not applied to them.

In other words, in the black monochromatic mode, the developing devices 5*a*, 5*b* and 5*c*, that is, the developing devices 5 in the stations other than the fourth station Sd, that is, the station for forming a black toner image, are kept in the position in which they are inactive, and the development rollers 5*a*, 5*b* and 5*c* are not rotated. Therefore, the developing devices 5*a*, 5*b* and 5*c*, which are not in use for the ongoing image formation, are prevented from being unnecessarily reduced in service life, and only the fourth station Sd which is for forming a black toner image is allowed to carry out an image forming operation.

3) While the image forming apparatus 100 is in the above described condition, the control circuit 102 begins to expose the drum 1*d* by turning on the scanner 3*d* in the fourth station Sd with a preset control timing. Thus, an electrostatic latent image is formed on only the drum 1*d*, that is, the drum 1 in the fourth station Sd; only the electrostatic latent image which corresponds to the black color component is formed. Then, the electrostatic latent image is developed as a black toner image by the developing device 5*d*.

Then, the black toner image is transferred (primary transfer) onto the portion of the belt 41, which is being moved through the primary transfer nip N1*d*. The transfer is done by the primary transfer roller 6*d*, to which a preset transfer bias is being applied from the electric power source 61*d*. The toner which failed to be transferred onto the belt 41 in the primary transfer nip N1*d*, remaining therefore on the peripheral surface of the drum 1*d*, is removed from the peripheral surface of the drum 1*d* by the cleaning device 7*d*.

4) The unfixed black toner image transferred onto the belt 41 is conveyed to the secondary transfer nip N2 by the subsequent movement of the belt 41, and is conveyed through the secondary transfer nip N2. While the unfixed black toner image is conveyed through the secondary transfer nip N2, it is transferred onto a sheet P of recording medium, which was fed into the apparatus main assembly from the cassette 104 and was introduced into the secondary transfer nip N2 by the pair of registration rollers 107 with the preset control timing as described above. Then, the sheet P is discharged as a finished monochromatic print into the delivery tray 110 through the fixing device 108.

5) To the cleaning roller 80, a combination of an AC voltage which is 1,000 Hz in frequency, 2,000 V in peak-to-peak voltage, and rectangular in waveform, and 1.3 kV of DC voltage is applied as it is in the full-color mode. Thus, the residual toner on the belt 41, that is, the toner which was not transferred from the belt 41 onto a sheet P of recording medium, is given positive electric charge.

Then, the positively charged residual toner on the belt 41 is moved sequentially through the primary transfer positions N1*a*, N1*b*, and N1*c* of the first, second, and third stations Sa, Sb and Sd, by the subsequent movement of the belt 41, without being transferred back onto the drums 1*a*, 1*b* and 1*c*, respectively, because of the control which will be described in Section (4). Then, it reaches the primary transfer nip N1*d* in the fourth station Sd. Then, it is transferred back onto the drum 1*d* in the fourth station Sd during the immediately following primary transfer, and is recovered by the cleaning device 7*d*.

6) The control circuit 102 makes the image forming apparatus 100 repeat the above described image forming operation until prints are outputted by the number preset in the requested job, and stops the image forming apparatus 100.

As soon as the control circuit 102 finishes the printing job, it puts the cam 111 in the fourth station Sd, which is in the inactive state, into the active state, moving thereby the developing devices 5*d* in the station Sd into the inactive position in order to separate the development roller 51*d* from the drum 1*d*. Further, the control circuit 102 turns off the electric power source for bias application. Further, it turns off the driving mechanisms 11, 55*d* and 45, stopping the driving of the drums 1, development roller 51*d* and belt 41. Then, the control circuit 102 keeps the apparatus 100 on standby until it receives the next print request.

(4) Sequence for Cleaning Intermediary Transferring Member in Black Monochromatic Mode From the standpoint of preventing the problem that in the black monochromatic mode, the waste toner container in the station S which is not being used for the ongoing image forming operation is filled up with the secondary transfer residual toner on the belt 41, it is desired that in the black monochromatic mode, the secondary transfer residual toner on the belt 41, which is from the station S (station Sd) which is in use, is recovered into the cleaning device 7*d* of the fourth station Sd.

In the black monochromatic mode, therefore, the drums 1*a*, 1*b* and 1*c* in the stations Sa, Sb and Sc, that is, the stations which are not in use for the ongoing image formation, are exposed in the same pattern as the pattern in which the drum 1*d* of the fourth station Sd is exposed to form a black monochromatic toner image. That is, the drums 1*a*, 1*b* and 1*c* are exposed in such a pattern that prevents the secondary transfer residual toner, which was given positive charge by the belt cleaning roller 80 and was conveyed to the primary transfer nips N1*a*, N1*b*, and N1*c* by the subsequent movement of the belt 41, from being recovered by the drums 1*a*, 1*b* and 1*c* in the primary transfer nips N1*a*, N1*b* and N1*c*.

That is, the drums 1*a*, 1*b* and 1*c* in the stations Sa, Sb and Sc, respectively, which are on the upstream side of the station Sd, are exposed in the same pattern as the pattern in which the drum 1*d* in the station Sd is exposed. As for the timing of the exposure, it is delayed by a length of time equal to the length of time it takes for the belt 41 to be circularly moved one full turn, compared to the timing with which they are exposed in the full-color mode. Thus, the secondary transfer residual toner on the belt 41 is not recovered in the stations Sa, Sb and Sc; it is recovered in the station Sd.

As the drums 1*a*, 1*b* and 1*c* in the stations Sa, Sb and Sc, respectively, are exposed in the same pattern as the pattern in which the drum 1*a* in the station Sd is exposed, the exposed points of the peripheral surface of each of the drums 1*a*, 1*b* and 1*c* becomes −110 V in potential level. Thus, the primary transfer bias to be applied in the stations Sa, Sb and Sc is set to −400 V, generating such a positive electric field, in the adjacencies of the exposed points, that makes the toner transfer from the drums 1*a*, 1*b* and 1*c* onto the belt 41.

Next, the sequence for cleaning the belt 41 during an image forming operation in the monochromatic mode (sequence for cleaning intermediary transferring member) is described in detail.

1) As image formation signals which correspond to the pattern (first pattern) of the black image to be printed (formed) is inputted into the control circuit 102 from the host apparatus 200 through the image formation signal receiving means 101, the control circuit 102 begins to operate the image forming apparatus 100 in the black monochromatic mode.

That is, the control circuit 102 begins to circularly move the belt 41, and also, rotate all the drums 1*a*, 1*b*, 1*c* and 1*d* as described above. The drum 1 in each station S is rotationally driven by the same driving force source 11 at the same time. To the charge rollers 2*a*, 2*b*, 2*c* and 2*d* in the stations Sa, Sb, Sc and Sd, respectively, −990 V of DC voltage is applied, and therefore, the drum 1 in each station S is charged. The biases to be applied to the charge rollers 2*a*, 2*b*, 2*c* and 2*d* in the stations Sa, Sb, Sc and Sd are supplied by the same high voltage power source 21.

2) Then, the developing device 5*d* in the fourth station Sd, that is the station S for forming a black monochromatic toner image, is moved into the development position by the cam 111*d*, whereby the development roller 51*d* is placed in contact with the drum 1*d*. Then, the development roller 51*d* is rotated while −350 V of DC voltage is applied to the development roller 51*d*. The peripheral surface of the drum 1*d* is exposed in the first exposure pattern by the scanner 3*d*. Thus, an electrostatic latent image is effected on the peripheral surface of the drum 1*d*. This electrostatic latent image is developed into a black toner image by the developing device 5*d*.

Initially, the drums 1 in the stations S which are not in use for the ongoing image forming operation are not exposed. Further, the developing devices 5*a*, 5*b*, and 5*c* are kept in their inactivation position, and the development rollers 51*a*, 51*b* and 51*c* are kept separated from the drums 1*a*, 1*b* and 1*c*, respectively.

3) The subsequent movement of the developed black toner image is described with reference to the schematic drawing in FIG. 4. To the primary transfer roller 6*d* in the fourth station Sd, that is, the station S for forming a black toner image, a preset primary transfer bias is applied from the power source 61*d*. Thus, the black toner image which is on the drum 1*d* and is in the first exposure pattern is transferred (primary transfer) onto the belt 41 in the primary transfer nip N1*d*, as shown in FIG. 4(A).

Hereafter, the area of the belt 41, on which the transferred black toner image in the first exposure pattern is present, will be referred to as the first area.

4) The black toner image on the belt 41 is transferred (secondary transfer) onto a sheet P of recording medium by the secondary transfer bias applied to the secondary transfer roller 90, in the secondary transfer nip N2, as shown in FIG. 4(B).

Figure 4:
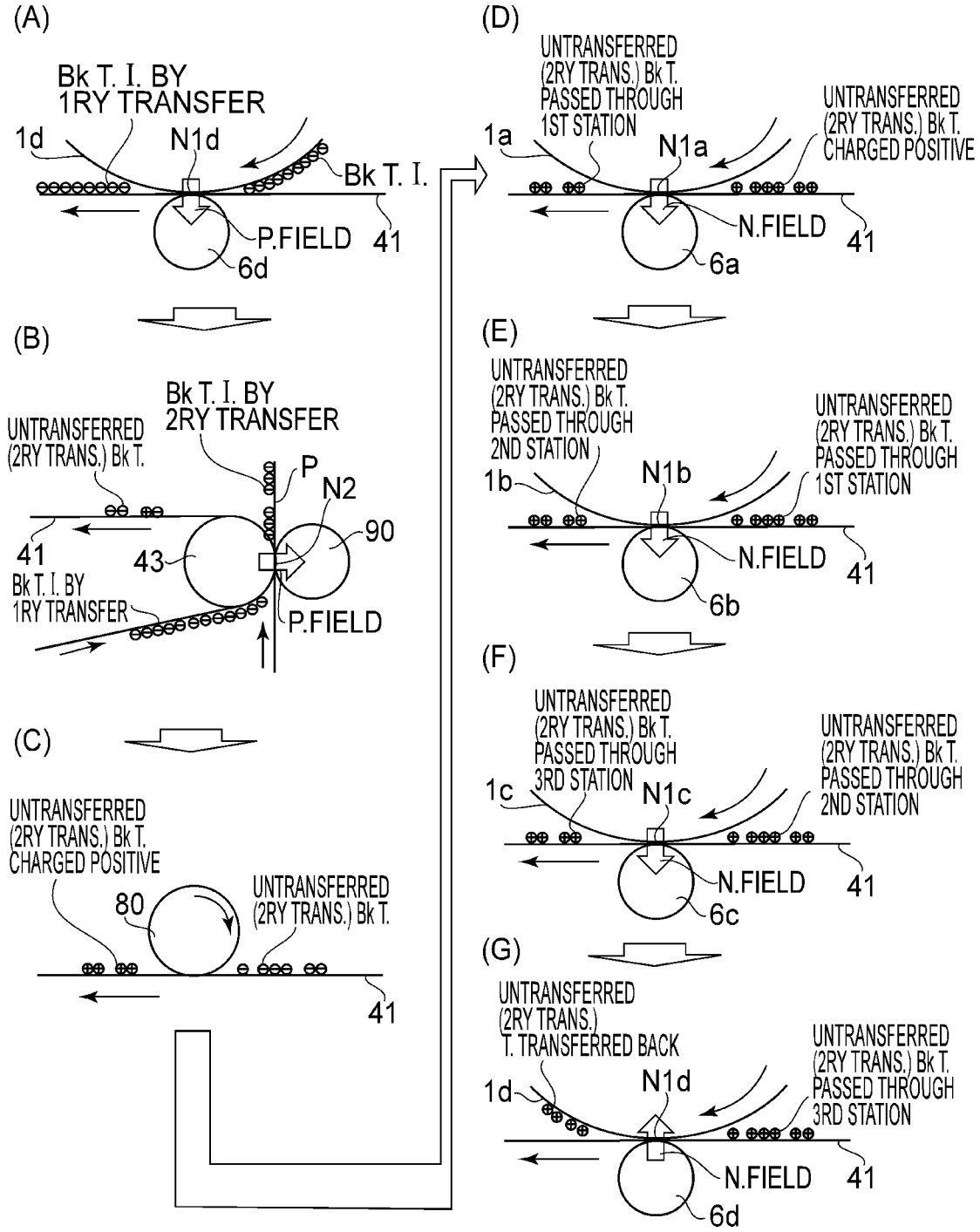
FIG. 4 is a schematic drawing for describing the toner movements which occur when the image forming apparatus in the first embodiment is in the black monochromatic mode.

The toner of the black toner image, which failed to be transferred from the belt 41, and therefore, is remaining on the belt 41, is positively charged (switched in polarity from negativity (normal polarity of toner) to positivity) by the belt cleaning roller 80 to which a preset cleaning bias is being applied from the power source 81, as shown in FIG. 4(*c*). The secondary transfer residual toner remains on the first area of the belt 41 even after it was positively charged.

5) Hereafter, the area of the peripheral surface of the drum 1*a* in the first station Sa, which is in the primary transfer nip N1*a* while the first area of the belt 41 moves through the primary transfer nip N1*a* in the first station Sa, will be referred to as the second area.

In order to recover the positively charged secondary transfer residual toner on the belt 41 in the fourth station Sd, that is, the station for forming a black toner image, the second area of the peripheral surface of the drum 1*a* in the first station Sa, which will come into contact with the first area of the belt 41 in the primary transfer nip N1*a*, is exposed in the second exposure pattern.

The second exposure pattern is set through computation by an exposure pattern setting portion 102A (as exposure pattern setting means) of the control circuit 102, based on the first exposure pattern inputted into the control circuit 102 from the host apparatus 200 through the image formation signal receiving means 101.

In order to prevent the stations Sa, Sb and Sc from recovering the secondary transfer residual toner on the belt 41, the following are necessary. That is, the area of the peripheral surface of each of the drums 1*a*, 1*b* and 1*c*, with which the first area of the belt 41, that is, the portions of the area of the belt 41, on which the secondary residual toner is present, which will come into contact in the primary transfer nips N1*a*, N1*b* and N1*c*, needs to be reduced in potential by exposure so that it becomes slightly negative. On the other hand, the portions of the first area of the belt 41, on which the secondary transfer residual toner is not present, do not need to be exposed. Therefore, the portions of the peripheral surface of each of the drums 1*a*, 1*b* and 1*c*, which will come into the portions of the first area of the belt 41, on which the secondary transfer residual toner is not present, in the primary transfer nips N1*a*, N1*b* and N1*c*, are not reduced in potential. Therefore, the drums 1*a*, 1*b* and 1*c* are prevented from being deteriorated by the exposure.

The portions of the first area of the belt 41, on which the secondary transfer residual toner is present, correspond to the portions of the peripheral surface of the drum 1*d* in the fourth station Sd, which correspond to the black portions of the image to be formed by the exposure in the first exposure pattern. The portions of the first area of the belt 41, on which the secondary transfer residual toner is not present, correspond to the portions of the peripheral surface of the drum 1*d* in the fourth station Sd, which correspond to the blank portions (white portions: toner-free portions) of the image to be formed by the exposure in the first exposure pattern.

The second area of each of the drums 1*a*, 1*b* and 1*c* in the stations Sa, Sb and Sc, respectively, is exposed in the second exposure pattern before it comes into contact with the first area of the belt 41, in the primary transfer nips N1*a*, N1*b* and N1*c*. The second exposure pattern is such an image pattern that exposes the portions of the peripheral surface of the drum 1, which correspond to the black portions of the image to be formed by the first exposure pattern.

The method for determining the portions of the peripheral surface of the drum 1 in each of the stations Sa, Sb and Sc, which are to be exposed, will be described later in detail. However, the amount by which the drums 1*a*, 1*b*, and 1*c* are deteriorated by the exposure can be reduced by increasing the portions of the peripheral surface of each of the drums 1*a*, 1*b* and 1*c*, which are not exposed to the beam of laser light when the second area of the peripheral surface of each of the drums 1*a*, 1*b* and 1*c* is exposed in the second exposure pattern. That is, the portions of the second area, which are to be exposed in the second exposure pattern, are desired to be as small portions of the peripheral surface of the drum as possible that can be determined by the exposure pattern setting portion 102A, and include the adjacencies of the portions of the peripheral surface of the photosensitive drum to which black toner is to be adhered in accordance with the first exposure pattern.

Therefore, the drums 1*a*, 1*b* and 1*c* in the stations Sa, Sb and Sc, respectively, are exposed in the above described second exposure pattern. With this exposure, a positive electric field which makes the toner move from the drum 1*a* onto the belt 41 in the primary transfer nip N1*a* is generated in the station Sa, corresponding to the area of the belt 41, on which the secondary transfer residual toner is present, as shown in FIG. 4(D). To the primary transfer roller 6*a*, −400 V of bias is applied as no-recovery bias, that is, bias for preventing the secondary transfer residual toner on the belt 41 from being recovered by the drum 1*a*.

Therefore, the positively charged toner on the belt 41 is not recovered in the first transfer nip N1*a* in the first station Sa. That is, it is conveyed through the first transfer station N1*a*, and is sent to the second station Sb, that is, the immediately downstream station S of the stations Sa.

6) Also in the second station Sb, the second area of the peripheral surface of the drum 1*b*, that is, the area of the peripheral surface of the drum 1*b*, which moves through the primary transfer nip N1*b* when the first area of the belt 41 moves through the primary transfer nip N1*b*, is exposed in the second exposure pattern, that is, the same pattern as the pattern in which the first area of the peripheral surface of the drum 1*a* was exposed in the primary transfer nip N1*a*. To the primary transfer roller 6*b*, −400 V of bias is applied as no-recovery bias, that is, bias for preventing the secondary transfer residual toner on the belt 41 from being recovered by the drum 1*b*, from the electric power source 61*b*.

7) In the third station Sc, the second area of the peripheral surface of the drum 1*c*, that is, the area of the peripheral surface of the drum 1*c*, which moves through the primary transfer nip N1*c* when the first area of the belt 41 moves through the primary transfer nip N1*c*, is exposed in the second exposure pattern, that is, the same pattern as the pattern in which the first area of the peripheral surface of the drum 1*a* was exposed in the primary transfer nip N1*a*. To the primary transfer roller 6*c*, −400 V of bias is applied as no-recovery bias, that is, bias for preventing the secondary transfer residual toner on the belt 41 from being recovered by the drum 1*c*, from the electric power source 61*c*.

Therefore, the secondary transfer residual toner on the first area of the belt 41 moves through the primary transfer nips N1*b* and N1*c*, and is sent to the fourth station Sd, or the most downstream station S, as shown in FIGS. 4(E) and 4(F). To the primary transfer roller 6*d* in the fourth station Sd, −800 V of transfer bias, which is the same as the primary transfer bias to be applied during a normal image forming operation, is applied from the electric power source 61*d*.

Therefore, a negative electric field which causes the positively charged secondary transfer residual toner to move from the belt 41 onto the drum 1*d* in the primary transfer nip N1*d* is generated in the primary transfer nip N1*d*, as shown in FIG. 4(G). Therefore, the positively charged secondary transfer residual toner on the belt 41 is transferred back onto the drum 1*d* in the station Sd, which is for forming a black toner image. Then, the secondary transfer residual toner is scraped away from the drum 1*d* by the cleaning blade 71*d* of the cleaning device 7*d*, and is recovered into the waste toner container 72*d*.

The above-described process can be carried out while the station Sd, or the station for forming a black toner image, is being used for image formation. That is, it can be carried out during a continuous job, that is, a job in which multiple prints are continuously made. Thus, this operation of exposing the drums 1*a*, 1*b*, and 1*c* in the stations Sa, Sb and Sc, respectively, in the second exposure pattern, which is set with the use of the method (which will be described later) based on the image formation signals for forming a black toner image, is repeated until the ongoing continuous job for forming a monochromatic toner image is completed.

9) As soon as the job is completed, the control circuit 102 separates the development roller 51*d* from the drum 1*a* by moving the developing device 5*d* in the station Sd with the use of the cam 111*d* into the no-development position, and stops the rotation of the development roller 51*d*. Further, the control circuit 102 stops applying the development bias, transfer bias, cleaning bias, and charge bias, and stops the belt 41 and drum 1. Then, it keeps the image forming apparatus 100 on standby until the next print request is inputted.

(5) Method for Setting Second Exposure Pattern

Next, the method for setting the second exposure pattern is described in detail. In the monochromatic mode, the charge bias is applied to the charge rollers 2*a*, 2*b* and 2*c* of the first, second, and third stations Sa, Sb and Sc, respectively, as well as to the drum 1*d* in the fourth station Sd, which is used for the ongoing image forming operation. That is, the drums 1*a*, 1*b*, and 1*c* of the stations Sa, Sb and Sc, respectively, also are charged to a preset potential level VD (dark potential level). As a given point of the charged area of the peripheral surface of the drum 1 is exposed, its potential reduces to a level VL (light potential level). Thus, as the exposed point is moved to the charge roller 2*a*, 2*b* and 2*c*, the difference between its potential level and the potential level of the charge bias becomes greater than firing potential. Therefore, the drums 1*a*, 1*b* and 1*c* are likely to be shaved by electrical discharge.

Therefore, the second exposure pattern is desired to be as small as possible in the overall exposure area, that is, areas through which the peripheral surface of each drum 1 is exposed to a beam of laser light. In this embodiment, the exposure pattern setting portion 102A of the control circuit 102 divides the first exposure pattern (pattern for black toner image) inputted into the control circuit 102 from the host apparatus 200 through the image formation signal receiving means, into multiple areas, and determines whether or not each area includes a portion which corresponds to a black portion of the black toner image to be formed. Then, the control circuit 102 sets the second exposure pattern so that only the portions of the peripheral surface of the drum 1 in each of the stations Sa, Sb and Sc, which were determined to correspond to the black areas of the black toner image to be formed, are exposed to the beam of laser light.

Here, the second exposure pattern may be the same in pattern as the first exposure pattern. However, in order to ensure that the secondary transfer residual toner on the belt 41 is fully recovered in the station Sd, or the station for forming a black toner image, without being affected by the positional deviation or the like, the second exposure pattern is desired to be slightly larger in the area through which the drum 1 is to be exposed to the beam of laser light. More specifically, the first exposure pattern is divided into (n×m) cells which are 10 mm in dimension in terms of the primary scan direction, and 2 mm in dimension in terms of the secondary scan direction, and each cell can be identified by its coordinate (x, y), wherein x=1-n, and y=1-m.

Figure 5:
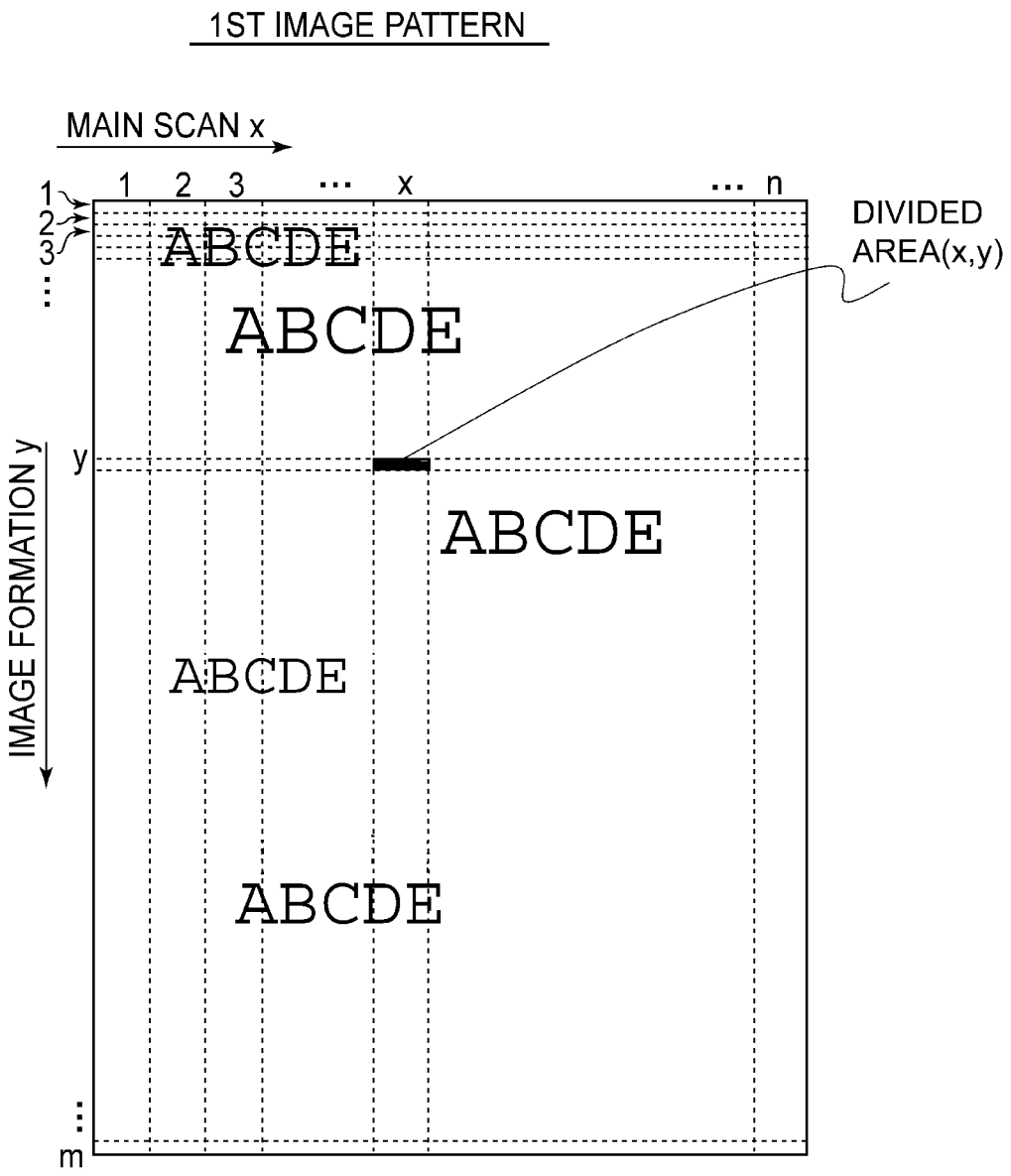
FIG. 5 is a drawing for showing how the first exposure pattern is divided.
Figure 6:
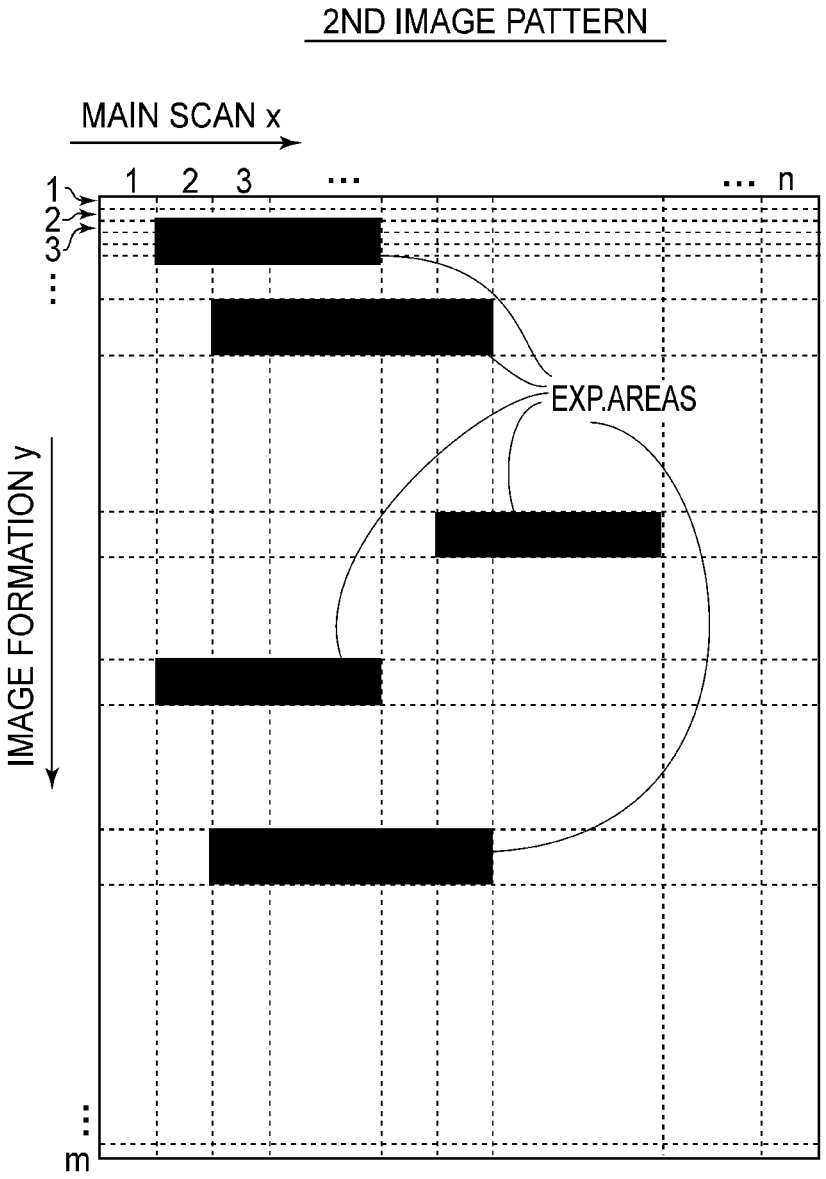
FIG. 6 is a drawing for showing the second exposure pattern in which the image formation area of the photosensitive member is exposed.

FIG. 5 shows one of the examples of the first exposure pattern, and the cells in which the pattern is divided. If a given cell, the coordinate of which is (x, y), includes the portion of the exposure pattern, which corresponds to the black portion of the black toner image to be formed, the exposure pattern setting portion 102*a* of the control circuit 102 determines that the entirety of the cell (x, y) is to be exposed to the beam of laser light. After the redefinition of all the cells, all the cells are recombined, effecting thereby a second exposure pattern such as the one shown in FIG. 6.

The second exposure pattern obtained through the process described above is used to expose, with the above described timing, the drums 1*a*, 1*b* and 1*c* in the stations Sa, Sb and Sc, that is, those which are not being used for the ongoing image forming operation in the black monochromatic mode. Thus, the secondary transfer residual toner, that is, the toner which failed to be transferred onto a sheet P of recording medium in the secondary transfer station N2, and therefore, is remaining on the belt 41, is not recovered in the stations Sa, Sb and Sc. Further, it is possible to minimize the intensity in the electrical discharge which occurs between the exposed portion of the drum 1 and the belt 41.

Therefore, it is unlikely to occur, in the black monochromatic mode, that the waste toner container in any of the stations Sa, Sb and Sc, which are not in use for the formation of a black toner image, is filled up with the waste toner. Further, the amount by which the drums 1*a*, 1*b* and 1*c* are shaved by the electrical discharge is minimized, along with the extent in which the process cartridges which correspond to the stations Sa, Sb and Sc are deteriorated due to the electrical discharge.

Incidentally, how the first image exposure pattern is divided and how the second image exposure pattern is created do not need to be limited to those described above. For example, in a case where a faint image is printed, the amount by which toner is used is small, and therefore, the amount of the secondary transfer residual toner is small. Therefore, the portions of the peripheral surface of each of the drums 1*a*, 1*b* and 1*c*, which correspond to the portions of the faint image, which are very small in the amount by which toner is to be adhered for their formation, do not need to be exposed.

Further, when creating the second exposure pattern, whether the amount of the secondary transfer residual toner is substantial or insignificant may be determined with the use of a parameter other than the above described one. For example, the amount of the secondary transfer residual toner may be estimated from the value of the output of a temperature sensor, a humidity sensor, and/or a secondary transfer current sensor 300 schematically shown in FIG. 3. If it is determined based on one or more these parameters that the amount of the secondary transfer residual toner is insignificant, it may be permissible not to expose the drums 1*a*, 1*b* and 1*c*, in order to prevent the drums 1 from being deteriorated by the exposure.

That is, it is possible to design the exposure pattern setting portion 102A so that if the portion 102A determines that a given point of the peripheral surface of a drum 1 corresponds to the portions of the first area of the belt 41, which is small in the amount of the secondary transfer residual developer (toner), this point will not be exposed at all, or the exposure light will be reduced in intensity.

Table 1 shows the difference between an electrophotographic full-color image forming apparatus in accordance with the prior art and the electrophotographic full-color image forming apparatus in this embodiment, in terms of the amount by which the surface layer of the drums 1*a*, 1*b* and 1*c* of the stations Sa, Sb and Sc, respectively, was shaved, and also, in terms of the amount by which the secondary transfer residual toner was recovered by the stations Sa, Sb and Sc, when the entirety of the peripheral surface of each of the drums 1*a*, 1*b* and 1*c* was exposed in order to prevent the problem that in the black monochromatic mode, the waste toner container in the stations Sa, Sb and Sc, that is, the stations S which are not being from being used for the ongoing image forming operation, is filled up with the secondary transfer residual toner from the station Sd.

TABLE 1

| | Prior Art | | Embodiments | | |
|---|---|---|---|---|---|
| | A1 | A2 | B1 | B2 | B3 |
| Black toner Remaining after 2ry transfer | yes | no | yes | no | no |
| Exposure | yes | yes | yes | yes | no |
| Area ratio of the area concerned in the image area | 2% | 98% | 2% | 10% | 88% |
| Charging bias voltage (V) | −990 | −990 | −990 | −990 | −990 |
| Potential (V) of drum after exposure | −110 | −110 | −110 | −110 | −480 |
| 1ry transfer bias (V) | −400 | −400 | −400 | −400 | −400 |
| 1ry transfer contrast (V) | −290 | −290 | −290 | −290 | 80 |
| Toner collection(back transfer) | no | no | no | no | no |
| Drum scrape amount | large | large | large | large | small |

The pattern in which the drums 1*a*, 1*b* and 1*c* were exposed by the apparatus in accordance with the prior art, is equivalent to a case in which the second exposure pattern in this embodiment is created as a solid black image pattern, that is, a pattern for exposing the entirety of the peripheral surface of each of the drums 1*a*, 1*b* and 1*c*, regardless of the first exposure pattern. Here, in consideration of the fact that most of prints are relatively low in printing ratio, it is assumed that the area of a black image, which corresponds to the area of recording medium to which black toner is adhered, is 2% in size. Incidentally, in the following comparison between the image forming apparatus in accordance with the prior art and the apparatus in this embodiment, the first, second, and third stations Sa, Sb and Sc, that is, the stations S which are not used for the formation of a black toner image are described. These three stations are the same in operation. Therefore, their operation is described as the operation of one of them.

In the case of the apparatus in accordance with the prior art (which hereafter will be referred to simply as conventional apparatus), the area of the drum, which is in the primary transfer nip when the secondary transfer residual toner is conveyed through the primary transfer nip, and is exposed to prevent the transfer of the secondary transfer residual toner onto the drum, occupies 2% of the image formation area to be entirely exposed. Thus, the area of the drum which is in the primary transfer nip when the secondary transfer residual toner is in the primary transfer nip, and is exposed before it enters the primary transfer nip, occupies 98% of the image formation area to be entirely exposed.

Hereafter, the former is referred to as an area A1, and the latter is referred to as an area A2. As −990 V of charge bias is applied to the charge roller, the peripheral surface of the drum is charged to −480 V. Then, it is entirely exposed. Therefore, before the areas A1 and A2 reach the primary transfer nip, their surface potential reduces to −110 V. In order to allow the secondary transfer black residual toner to move through the primary transfer nip without being transferred onto the drum, −400 V of transfer bias is applied to the primary transfer roller. Thus, the positive transfer contrast which works in the direction to make the secondary transfer residual toner move from the drum onto the belt, that is, the difference between the potential level of the peripheral surface of the drum after the full exposure and the transfer bias applied to the primary transfer roller, is −290 V.

Since there is a negative electric field, which works in the direction to move the positively charged toner from the drum onto the belt, around the area A1, the secondary transfer black residual toner is not recovered by the area A1 of the drum. Further, the area A2 is in the same electric field as the one in which the area A1 is, and also, there is no secondary transfer residual toner on the portion of the belt 41, which corresponds to the area A2. Therefore, no toner is recovered by the area A2. That is, the secondary transfer residual black toner is not recovered by the drum at all.

In this embodiment, the area of the peripheral surface of the drum, onto which the secondary transfer residual black toner will have been transferred in the primary transfer nip, and is exposed before the area is moved into the primary transfer nip, is 2% of the area of the peripheral surface of the drum, which is to be exposed in the second exposure pattern. This area hereafter will be referred to as an area B1.

Further, the area of the peripheral surface of the drum, which opposes, in the primary transfer nip, the area of the belt, on which the secondary transfer residual black toner is not present, and is to be exposed (to beam of laser light) before it is moved into the primary transfer nip, occupies 10% of the area of the peripheral surface of the drum, which is to be exposed in the second exposure pattern, This area will be referred to as an area B2, hereafter. The area B2 is such an area that will be created by exposing a larger area of the peripheral surface of the drum than the area by which the peripheral surface of the drum is exposed by the first exposure pattern, with the use of the above described exposure pattern setting method.

Further, the area of the peripheral surface of the drum, which opposes, in the primary transfer nip, the portion of the belt, which does not have the secondary transfer residual black toner, and therefore, is not exposed (to beam of laser light) before it reaches the primary transfer nip, occupies 88% of the peripheral surface of the drum, which is to be exposed in the second exposure pattern. This area will be referred to as a third area B3 hereafter.

To the charge roller, −990 V of charge bias, which is the same as the one applied in the conventional image forming apparatus, is applied. Therefore, the potential of the peripheral surface of the drum becomes −480 V. Thus, the potential of the areas B1 and B2 of the peripheral surface of the drum reduces to −110 V before the areas B1 and B2 reach the primary transfer nip. In this embodiment, however, the peripheral surface of the drum is exposed in the second exposure pattern which reflects whether or not the secondary transfer residual toner is present on the corresponding areas of the belt, unlike in the conventional apparatus. Therefore, the area B3, which corresponds to the area of the first exposure pattern, which correspond to the portions of recording medium, to which black toner is not to be adhered, is not exposed. Therefore, before the area B3 of the peripheral surface of the drum reaches the primary transfer nip, its potential is −480 V. The transfer bias to be applied to the primary transfer roller is −400 V, which is the same as the one applied in the conventional apparatus.

Thus, the transfer contrast between the charge roller and area B1, and that between the charge roller and area B2 are −290 V, whereas that between the charge roller and area B3 is 80 V. Therefore, the toner is not transferred (recovered) onto the area B1 in the primary transfer nip, as it is not transferred onto the area A1 in the conventional apparatus. Further, the toner is not transferred (recovered) onto the area B2, as it is not transferred onto the area A2 in the conventional apparatus. The area B3 is in the negative electric field which has an effect of making the positively charge toner move from the belt onto the drum. However, there is no secondary transfer residual toner on the portion of the belt, which corresponds to the area B. Therefore, no toner is recovered. That is, like in the conventional apparatus, the secondary transfer residual black toner is not recovered at all by the drum.

Up to this point in this document, it has been described that both the conventional apparatus and the apparatus in this embodiment can prevent the problem that the waste toner container in any of the stations S, which are not being used for an ongoing monochromatic image forming operation, may be filled up with the secondary transfer residual toner from the station S which is being used for the ongoing monochromatic image forming operation. Next, the difference between the conventional apparatus and the apparatus in this embodiment in terms of the amount by which the peripheral layer of a drum is shaved is described. In the conventional apparatus, when the areas A1 and A2 are recharged after being conveyed through the primary transfer nip, the difference between their potential and charge bias potential exceeds the break-down voltage. Therefore, electrical discharge occurs between the charge roller and drum.

Also in this embodiment, the areas B1 and B2 of the drum are exposed (to beam of laser light), being therefore reduced in potential. Therefore, electrical discharge occurs between the charge roller and drum. The amount by which the areas A1 and A2 in the conventional apparatus are shaved by this electrical discharge, and the amount by which the areas B1 and B2 in this embodiment are shaved by this electrical discharge, are substantial, whereas the amount by which the area B3 in this embodiment is shaved by the electrical discharge is very small, because the area B3 is not reduced in potential by exposure, and therefore, it is minimized in the amount of electrical discharge between itself and the charge roller.

In other words, unlike the drum in the conventional apparatus, the peripheral surface of the drum in this embodiment has the area B3, that is, the area which is not exposed (to beam of laser light). Therefore, the drum in the apparatus in this embodiment is not worn as much as the drum in the conventional apparatus. In particular, in a black image forming operation which is small in print ratio, the ratio of the area B3 relative to the entirety of the image formation area is substantial. Therefore, the apparatus in this embodiment is substantially larger in terms of the area of the peripheral surface of the drum which is prevented from being worn by the electrical discharged, than the conventional apparatus.

Up to this point in this document, the conventional apparatus and the apparatus in this embodiment have been compared with reference to an image forming operation in which only a single black monochromatic print is outputted. However, the present invention is just as effective when multiple black monochromatic prints (images) are continuously outputted. That is, the image forming apparatus in this embodiment is smaller in average, in the amount by which the drum is shaved than a conventional image forming apparatus. Table 2 shows the results of an experiment in which the amount by which the surface layer of the drum was shaved and the amount by which waste toner was recovered, when an image which is 2% in print ratio was continuously formed while shifting the image formation area in such a manner that the print ratio in terms of the primary scan direction changes for each print.

TABLE 2

| | Prior art | Embodiments | |
|---|---|---|---|
| No. of prints in monochromatic mode | 20000 | 20000 | 24580 |
| Collection amount of residual toner (g) | 2 | 2 | 2.5 |
| Rest amount of collectable residual toner (g) | 28 | 28 | 27.5 |
| Drum scrape amount (μmm) | 5.9 | 4.8 | 5.9 |
| Drum film thickness (μm) | 12.1 | 13.2 | 12.1 |

In this experiment, the image forming apparatus was temporarily stopped for every five prints during the continuous printing operation. Further, six process cartridges 8*d*, that is, process cartridges for the formation of a black toner image, were used, but none of the process cartridges 8*a*, 8*b* and 8*c* were replaced. The results given in Table 2 are for the first station Sa. The results for the second and third stations Sb and Sc, which also were the stations which were not used for the image forming operation (for forming black toner image), were the same as those for the stations Sa.

Each waste toner container can recover 30 g of waste toner without such a problem as being brimmed. The value obtained by subtracting the amount of the recovered waste toner from this capacity (30 g) of the waste toner container is the residual capacity, that is, the amount by which waste toner is recoverable by the container.

The thickness of the surface layer of the drum in Table 2 is the value obtained by averaging the average thickness of the area of the peripheral surface of the drum which was exposed for image formation, in terms of the rotational direction of the drum, and that in terms of the primary scanning direction. Both the drum of the conventional image forming apparatus and that of the image forming apparatus in this embodiment were 18 μm in the thickness of their surface layer.

First, the example of conventional image forming apparatus and the image forming apparatus in this embodiment is compared in the amount by which waste toner was recovered in the stations Sa, Sb and Sc, that is, the stations which were not used for image formation in the black monochromatic mode, when 20,000 prints were outputted in the black monochromatic mode. The total amount of the secondary transfer residual toner sent to the primary transfer nip N1*a* in the first station Sa was roughly 90 g. The amount by which waste toner was recovered by each of the first, second, and third stations Sa, Sb and Sc was 2 g. In other words, most of the secondary transfer residual toner was sent to the fourth station Sd, that is, the station for forming a black toner image, and was recovered by the station Sd. Thus, the residual waste toner capacity of the waste toner container in each of the stations Sa, Sb and Sc was 28 g. Therefore, as long as the number of prints which are to be continuous outputted in the black monochromatic mode is no more than 20,000, it is unlikely that the waste container in any of the stations Sa, Sb and Sc will be filled up with the secondary transfer residual toner from the stations Sd.

The effect of an image forming operation in the black monochromatic mode upon the residual capacity of the waste container in each of the stations Sa, Sb and Sc is very small. Therefore, even if a certain amount of waste toner has accumulated in the waste toner container in each of the stations Sa, Sb and Sc as a result of the preceding image forming operation in the full-color mode, it is possible to avoid the problem that the waste toner container in any of the stations Sa, Sb and Sc is filled up with the secondary transfer residual toner from the station Sd. That is, the image forming apparatus in this embodiment can avoid the problem that as an image forming apparatus is increased in the frequency with which it is operated in the black monochromatic mode, the waste toner container in any of the stations Sa, Sb and Sc is filled up with the secondary transfer residual toner from the station Sd.

Next, after a continuous black monochromatic image forming operation in which 20,000 prints were outputted, the conventional image forming apparatus, and the image forming apparatus in this embodiment, were compared in terms of the thickness of the surface layer of the drums 1*a*, 1*b* and 1*c* in the stations Sa, Sb and Sc, that is, the stations S which were not used for the image formation in the black monochromatic mode. The surface layer of the drums of the conventional image forming apparatus was worn to a thickness of 12.1 μm, whereas the surface layer of the drums of the image forming apparatus in this embodiment was worn to only a thickness of 13.2 μm, proving that this embodiment can prevent the surface layer of the drums 1 from being worn by the aforementioned electrical discharge. Comparing the conventional image forming apparatus and the apparatus in this embodiment in terms of the amount by which the surface layer of the drum was worn, the amount by which the surface layer of the drum of the conventional image forming apparatus was 5.9 μm, whereas the amount by which the surface layer of the drums of the image forming apparatus in this embodiment was 4.8 μm.

In the case of the image forming apparatus in this embodiment, when a print (image) to be made is low in print ratio, a substantial area of the peripheral surface of the drums in the stations Sa, Sb and Sc is left unexposed. Therefore, the surface layers of the drums in these stations are prevented from being worn in the black monochromatic mode. Thus, the image forming apparatus in this embodiment is smaller in the amount by which the surface layer of the drums in the stations Sa, Sb and Sc are worn in the black monochromatic mode than the conventional apparatus, that is, the image forming apparatus in accordance with the prior art, even when the two apparatuses are the same in the number of prints outputted in the black monochromatic mode.

Described next is a case in which the image forming apparatus in this embodiment was continuously operated until the amount by which the surface layer of the drums in the stations Sa, Sb and Sc was worn becomes the same as the amount by which the surface layer of the drums in the stations Sa, Sb and Sc of the image forming apparatus in accordance with the prior art was shaved while 20,000 images are formed in the black monochromatic mode. In the case of the apparatus in this embodiment, it was while roughly the 2,4000th image was formed during a continuous image forming operation in the black monochromatic mode that the amount by which the surface layer of the drum 1*a* in the first station Sa became 5.9 μm. After the completion of the 24,000th image, the amount by which waste toner was recovered by the waste toner container in any of the stations Sa, Sb and Sc was only 2.5 g. In other words, the residual capacity of the waste toner container was 27.5 g, which is large enough for the apparatus to be continuously operated to output a substantial number of black monochromatic prints.

Comparing the state of the image forming apparatus in accordance with the prior art after the apparatus was used in the black monochromatic mode to produce 20,000 prints, with the state of the image forming apparatus in this embodiment after the apparatus was used in the black monochromatic mode to produce 24,000 prints, the two apparatuses were the same in the thickness of the worn surface layer of the drum, even though the apparatus in this embodiment was greater in the number of the produced prints. In other words, the present invention can increase an electrophotographic full-color image forming apparatus in the total number of images it can form during its service life. That is, the present invention can extend the image forming stations which are not in use for the formation of a black toner image, by reducing the speed at which the drums in these stations are deteriorated.

As described above, not only can the present invention can prevent the drum in each of the image forming stations on the upstream side of the image forming station which is used for the formation of black monochromatic toner image, from recovering the secondary transfer residual toner on the belt, by exposing the entirety of the peripheral surface of the drum, but also, it can minimize the drum in each of the stations which are not used for the formation of the black toner image, in terms of the deterioration attributable to the exposure.

Further, when the image forming apparatus in this embodiment is in the black monochromatic mode, it makes its fourth station Sd, that is, the station for forming a black toner image, recover the secondary transfer residual toner on the belt. Therefore, it is possible to prevent the problem that the waste toner container in any of the image forming stations which are on the upstream side of the image forming station which is used for the black toner image, is filled up with the secondary transfer residual toner from the station which is used for the formation of the black toner image.

That is, the present invention can prevent the problem that the waste toner container in the image forming stations which are not in use for the formation of a black monochromatic toner image are filled up with the secondary transfer residual toner from the image forming station which is in use for the formation of a black monochromatic toner image, while preventing the drums in the stations which are not in use for the formation of the monochromatic toner image from wearing. Therefore, it can extend in service life the stations, or the process cartridges, which are not used in the black monochromatic mode. In particular, in recent years, an electrophotographic full-color image forming apparatus has come to be widely used, and is frequently used in the black monochromatic mode. Thus, the present invention can extend in service life the image forming stations, or process cartridges, which are not used for the formation of a black monochromatic image.

[Miscellanies]

(1) Although this embodiment was described with reference to a case in which it was the most downstream station (fourth station Sd) in terms of the moving direction of the belt 41 that was used in the monochromatic mode. However, this embodiment is not intended to limit the present invention in scope. That is, the image forming station which is used in the monochromatic mode may any of the multiple image forming stations.

In a case in which the image forming station which is used in the monochromatic image formation mode is the most upstream image forming station in terms of the moving direction of the belt 41, the image bearing members in the downstream image forming stations are rotated, and also, charge bias is applied to the charging means in the downstream image forming station. However, the drums in the downstream stations are not exposed in the second exposure pattern.

In a case in which the image forming station which is used in the monochromatic mode is one of two stations between the most upstream and most downstream stations in terms of the moving direction of the belt 41, the above described sequence for cleaning the intermediary transferring member is executed for the stations on the upstream side of the station used in the monochromatic mode. In the stations on the downstream side of the station used in the monochromatic mode, however, the image bearing members (drums) are not exposed in the second exposure pattern, although the image bearing members (drums) are rotated, and charge bias is applied to the charging means.

(2) The application of the present invention is not limited to an electrophotographic full-color image forming apparatus that has only four image forming stations like the one in this embodiment. That is, the present invention is also applicable to an electrophotographic full-color image forming apparatus having two, three, or five or more image forming stations. Further, the present invention is also compatible with an electrophotographic image forming apparatus which can use transparent toner, white toner, etc., in addition to the aforementioned color toners which are different in color.

(3) Further, the application of the present invention is not limited to an electrophotographic full-color image forming apparatus, the intermediary transferring member of which is an endless belt like the one in this embodiment. That is, the present invention is also applicable to an electrophotographic full-color image forming apparatus, the intermediary transferring member of which is a rotatable drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 166700/2011 filed Jul. 29, 2011, which is hereby incorporated by reference herein.

What is claimed is:

1. An image forming apparatus comprising:

a movable intermediary transfer member for receiving a developed image;

a plurality of image forming stations arranged along a moving direction of said intermediary transfer member, said image forming stations each including a rotatable image bearing member, charging means for charging said image bearing member, exposure means for exposing said image bearing member charged by said charging means to light to form an electrostatic latent image on said image bearing member, developing means for developing the electrostatic latent image formed on said image bearing member into a developed image, primary transferring means for primary-transferring the developed image from said image bearing member onto said intermediary transfer member at a primary transfer position, and image bearing member cleaning means for removing a developer remaining on said image bearing member after transfer of the developed image from said image bearing member onto said intermediary transfer member, wherein different color developed images are formed on different image bearing members;

secondary transferring means for secondary-transferring the developed image from said intermediary transfer member onto a recording material at a secondary transfer position; and control means for controlling said plurality of image forming stations, wherein said control means can execute a collecting operation by said image forming stations to collect the developer remaining on said movable intermediary transfer member which has not been secondary-transferred onto the recording material by said secondary transferring means, wherein said control means can execute an exposure control for exposing to light said image bearing member of at least one of said image forming stations to control an amount of the developer collected by said at least one of said image forming stations, in the collecting operation, and wherein said control means can change a pattern of the exposure of said image bearing members in the exposure control in accordance with the developed image primary-transferred onto said intermediary transfer member.

2. An apparatus according to claim 1, wherein said control means controls on the execution of the collecting operation the exposure such that no or less exposure is effected when it is discriminated that an amount of the developer remaining on said intermediary transfer member is relatively smaller than when it is discriminated that the amount is relatively larger.

3. An apparatus according to claim 2, wherein the amount of the remaining developer is discriminated from any of a temperature, a humidity and a current through said secondary transferring means.

4. An apparatus according to claim 1, wherein when it is discriminated that the surface of said intermediary transfer member includes a part where an amount of the remaining developer is small, said control means controls the exposure such that no or less exposure is effected for a region of said image bearing members which contact the part, in the execution of the collecting operation.

5. An apparatus according to claim 4, wherein the amount of the developer remaining on the surface of said intermediary transfer member is discriminated on the basis of a printing toner amount.

6. An apparatus according to claim 1, wherein in said image forming stations in which the exposure control is effected in the collecting operation, the collection of the developer is suppressed.

7. An apparatus according to claim 1, wherein said control means can execute selectively a multi-color image forming mode operation in which said plurality of image forming stations are operated to form a multi-color image in which multi-color developed images are overlaid on said intermediary transfer member, or a monochromatic image forming mode operation in which one of said image forming stations is operated to form a monochromatic developed image on said intermediary transfer member, wherein said image forming stations include a first image forming station which is operated in the monochromatic mode operation and a second image forming station which is upstream of said first image forming station with respect to a movement direction of said intermediary transfer member, wherein said image bearing member of said first image forming station is exposed to a first exposure pattern to form the electrostatic latent image, and said image bearing member of said second image forming station is exposed to a second exposure pattern in the execution of the collecting operation, and wherein said control means determines the second exposure pattern in accordance with the first exposure pattern when the developer remaining on said intermediary transfer member as a result of an execution of the monochromatic image forming mode operation is collected.

8. An apparatus according to claim 7, wherein if a region of a surface of said intermediary transfer member at which the developed image formed by exposure of the first image pattern on said image bearing member of said first image forming station is transferred onto said intermediary transfer member is a first region, said control means controls to expose said image bearing member of said second image forming station in the exposure control for the execution of the collecting operation prior to the first region contacting said image bearing member of said second image forming station.

9. An apparatus according to claim 8, wherein a region of a surface of said image bearing member of said second image forming station which contacts the first region is a second region, and the exposure area by said second exposure pattern covers the second region.

10. An apparatus according to claim 7, wherein an exposure area of the second exposure pattern decreases with decrease of an exposure area of the first exposure pattern.

11. An apparatus according to claim 7, wherein said first image forming station is the downstream most image forming station of said plurality of image forming stations with respect to the moving direction of said intermediary transfer member.

12. An apparatus according to claim 7, wherein said first image forming station is an image forming station for forming a black image.

13. An apparatus according to claim 7, wherein said control means controls to rotate said image bearing members in said plurality of image forming stations and applies a charging bias voltage to charging means of said plurality of image forming stations, in the monochromatic image forming mode operation.

14. An apparatus according to claim 1, further comprising developer charging means for charging the developer remaining on said intermediary transfer member at a position downstream of the secondary transfer position and upstream of the primary transfer position of said image forming station which is at an upstream most position with respect to the movement direction of said intermediary transfer member, after the secondary transfer of the developed image from said intermediary transfer member onto the recording material.

15. An apparatus according to claim 1, further comprising developer charging means for charging the developer remaining on said intermediary transfer member to a polarity opposite to a regular polarity, wherein when the collecting operation is carried out, the collection is suppressed in said image forming station in which the exposure control is carried out, and the collection is effected in said image forming station in which the exposure control is not carried out.

* * * * *